US010156803B2

(12) United States Patent
Nakamura et al.

(10) Patent No.: US 10,156,803 B2
(45) Date of Patent: Dec. 18, 2018

(54) CARRIER FOR ELECTROSTATIC CHARGE IMAGE DEVELOPMENT AND TWO-COMPONENT DEVELOPER FOR ELECTROSTATIC CHARGE IMAGE DEVELOPMENT

(71) Applicant: Konica Minolta, Inc., Tokyo (JP)

(72) Inventors: Kosuke Nakamura, Hachioji (JP); Satoshi Uchino, Hino (JP); Futoshi Kadonome, Sagamihara (JP); Koji Shibata, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/581,775

(22) Filed: Apr. 28, 2017

(65) Prior Publication Data

US 2017/0329248 A1 Nov. 16, 2017

(30) Foreign Application Priority Data

May 10, 2016 (JP) ..... 2016-094817

(51) Int. Cl.
*G03G 9/113* (2006.01)
*G03G 9/087* (2006.01)
*G03G 9/107* (2006.01)

(52) U.S. Cl.
CPC ..... *G03G 9/1133* (2013.01); *G03G 9/08755* (2013.01); *G03G 9/08797* (2013.01); *G03G 9/1075* (2013.01); *G03G 9/1131* (2013.01); *G03G 9/1139* (2013.01)

(58) Field of Classification Search
CPC ..... G03G 9/1133; G03G 9/1138
See application file for complete search history.

(56) References Cited

U.S. PATENT DOCUMENTS 5,631,116 A * 5/1997 Uchida ..... G03G 9/1133 428/407
6,159,649 A * 12/2000 Macholdt ..... C09B 63/005 106/31.8
2008/0063969 A1* 3/2008 Yamaguchi ..... G03G 9/0819 430/110.2
2009/0245858 A1* 10/2009 Mizutani ..... G03G 9/0804 399/111
2010/0203439 A1* 8/2010 Zhou ..... G03G 9/0804 430/108.6
2010/0298519 A1* 11/2010 Nakamura ..... C08G 75/04 528/9
2011/0020748 A1* 1/2011 Nakayama ..... G03G 9/0825 430/114
2014/0065535 A1* 3/2014 Kinoshita ..... G03G 9/107 430/106.2
2015/0316867 A1 11/2015 Shoji et al.
2016/0238960 A1* 8/2016 Fukushima ..... G03G 9/1133
2016/0310426 A1* 10/2016 Wu ..... A61K 9/5153
2017/0277054 A1* 9/2017 Tanabe ..... G03G 9/1133

FOREIGN PATENT DOCUMENTS

JP 06289660 A * 10/1994
JP 2501885 B2 * 5/1996 ..... G03G 9/1133
JP 3136564 B2 * 12/2000
JP 2014174454 A 9/2014
JP 2015210483 A 11/2015

OTHER PUBLICATIONS

English language machine translation of JP 06-289660 (Oct. 1994).*
English language machine translation of JP 2501885 (May 1996).*
English language machine translation of JP 3136564 (Dec. 2000).*
English language machine translation of JP 2014-174454 (Sep. 2014).*
Actinide Research Quarterly, 2nd quarter 2004. "How XPS works" [online] Retrieved Oct. 16, 2018 from «https://www.lanl.gov/orgs/nmt/nmtdo/AQarchive/04summer/XPS.html».*

* cited by examiner

*Primary Examiner* — Christopher D Rodee
(74) *Attorney, Agent, or Firm* — Lucas & Mercanti, LLP

(57) ABSTRACT

Provided is a carrier for electrostatic charge image development which provides a two-component developer having a high electric charge amount, a suppressed variation in an electric charge amount caused by an environmental change, and excellent durability, even if a low temperature fixable toner is used.

A carrier for electrostatic charge image development of the present invention includes: carrier particles in which a core particle surface is coated with a coating material containing a resin, wherein the coating material contains phosphorus element, and the resin contains structural units derived from an alicyclic (meth)acrylic acid ester compound.

11 Claims, No Drawings

CARRIER FOR ELECTROSTATIC CHARGE IMAGE DEVELOPMENT AND TWO-COMPONENT DEVELOPER FOR ELECTROSTATIC CHARGE IMAGE DEVELOPMENT

CROSS-REFERENCE TO RELATED APPLICATION

This application is based on Japanese Patent Application No. 2016-094817 filed on May 10, 2016, the contents of which are incorporated herein by reference.

BACKGROUND

1. Technical Field

The present invention relates to a carrier for electrostatic charge image development, and a two-component developer for electrostatic charge image development using the same.

2. Description of Related Arts

Recently, it is required for toner to improve melt fixability to a recording medium upon fixing, to improve fixability at a low temperature for attaining saving energy, and to decrease a particle size for attaining improved image quality. In a low temperature fixable toner, low temperature fixation can be realized by using a resin having a low glass transition temperature or a crystalline resin as a binding resin.

When the resin having the low glass transition temperature is used, however, an external additive becomes easily solidified or buried, and electrostatic property is decreased. Also, the crystalline resin has a low resistance, and has a defect of decreased electric charge amount because it is difficult to hold charges generated and is decreased. In particular, there is a problem in which the resistance of the crystalline resin is further decreased and the electric charge amount is greatly decreased at a high temperature under a high humidity. On the other hand, when the size of particles forming the toner is decreased, a problem appears in which electrostatic property per particle is decreased due to a decreased surface area capable of frictional electrification or decreased fluidity per particle.

In order to solve the problems described above, development of a carrier for a two-component developer, which can improve the electrostatic property of the toner, even if the low temperature fixable toner is used, has been advanced. For example, JP 2014-174454 A discloses an example in which a resin having a high electrostatic property is used as a resin for coating a carrier, and thus, decrease of an electric charge amount is suppressed. JP 2015-210483 A (corresponding to US 2015/316867 A1) discloses an example in which a resin having a high hydrophobicity is used as the resin for coating the carrier, and thus, decrease of an electric charge amount is suppressed at a high temperature under a high humidity.

SUMMARY

The carrier disclosed in JP 2014-174454 A, however, has defects in which the electric charge amount is too large under a low temperature and low humidity environment and variation in the electric charge amount due to the environmental change becomes large. In addition, the carrier described in JP 2015-210483 A (corresponding to US 2015/316867 A1) has a defect in which the sufficient electrostatic property cannot be obtained at a high temperature under a high humidity, and excessive electrification is caused under a low temperature and low humidity environment.

The present invention, accordingly, has been made in view of the problems described above, and aims at providing a carrier for electrostatic charge image development, which has a high electric charge amount capable of improving an electric charge amount of a toner even if a low temperature fixable toner is used, suppresses the variation in the electric charge amount caused by the environmental change, and has excellent durability; and a two-component developer using the same.

The present inventors have made painstaking study in order to solve the problems described above; as a result, they have found that a carrier for electrostatic charge image development having the following components can solve the problems, and have completed the present invention.

To achieve at least one of the above-mentioned objects, a carrier for electrostatic charge image development reflecting one aspect of the present invention comprises carrier particles in which a core particle surface is coated with a coating material containing a resin, wherein the coating material contains phosphorus element, and the resin contains structural units derived from an alicyclic (meth)acrylic acid ester compound.

DETAILED DESCRIPTION

Embodiments of the present invention are explained in detail below. The present invention is not limited to the following embodiments.

In the instant specification, the phrase "X to Y" indicating a range means "X or more and Y or less." Operations and measurements of properties are performed at room temperature (20 to 25° C.) in a relative humidity of 40 to 50% RH. In the instant specification, the term "(meth)acrylic" refers to "methacrylic and/or acrylic."

The carrier for electrostatic charge image development according to the present invention (hereinafter which may refers to sometimes simply "carrier") contains carrier particles in which a surface of a core particle is coated with a coating material containing a resin, wherein the coating material contains phosphorus element, and the resin contains structural units derived from an alicyclic (meth)acrylic acid ester compound. The carrier having such a structure has the high electric charge amount capable of improving an electric charge amount of a toner even if a low temperature fixable toner is used, suppresses the variation in the electric charge amount caused by the environmental change, and has excellent durability. A mechanism exerting such effects is not completely clear, but the following mechanism can be presumed.

A moisture adsorption amount of the carrier particle is decreased by containing a structural unit derived from the highly hydrophobic alicyclic (meth)acrylic acid ester compound in the resin in the coating material, and thus, the decreased electric charge amount of the carrier is suppressed particularly at a high temperature under a high humidity. The coating material containing such structural units also has the appropriate electrostatic property and mechanical strength, and thus the friction of the coating material advances appropriately. For that reason, even if the toner particles or the external additive is spent (adheres) to the carrier particle surface, the carrier particle surface can be refreshed. The carrier, accordingly, can maintain the high electric charge amount even if it is repeatedly used, and has excellent durability.

In addition, the electric charge amount of the carrier is improved by containing the phosphorus element in the coating material, due to the influence of the strong positive electrostatic property of the phosphorus atom. In particular, a phosphorus element-containing compound such as phosphoric acid or a phosphoric acid ester has a property to easily retain moisture. For that reason, the coating material can retain the moisture even at a low temperature under a low humidity, and excessive electrification of the carrier can be suppressed.

The electric charge amount of the carrier, accordingly, can be improved by a synergistic effect of the alicyclic (meth) acrylic acid ester compound and the phosphorus element. In addition, the coating material is low moisture adsorbent as a bulk, and thus the decreased carrier electric charge amount can be suppressed at a high temperature under a high humidity, and the coating material can locally retain the moisture, and thus the excessive electrification of the carrier can be suppressed at a low temperature under a low humidity. As a result, the carrier can be obtained which has the high electric charge amount, and the suppressed variation in the electric charge amount caused by the environmental change (environmental difference in the electric charge amount is small).

The present invention is not limited to the mechanism described above.

The carrier for electrostatic charge image development and the two-component developer, according to the present invention, are explained below.

<Carrier for Electrostatic Charge Image Development>

The carrier for electrostatic charge image development according to the present invention contains carrier particles containing a core particle and a coating material which coats the core particle surface.

[Coating Material]

(Resin)

The coating material of the carrier particle in the present invention contains a resin. The resin is obtained by polymerizing a monomer containing an alicyclic (meth)acrylic acid ester compound. The resin, accordingly, contains structural units derived from the alicyclic (meth)acrylic acid ester compound. As the resin contains such structural units, the hydrophobicity of the coating material becomes high, and the moisture adsorption amount of the carrier particles is decreased, in particular, at a high temperature under a high humidity. For that reason, the decreased electric charge amount of the carrier can be suppressed at a high temperature under a high humidity. In addition, the structural units have a rigid cyclic backbone, and thus the film strength of the coating material is improved and good durability of the carrier is obtained.

The alicyclic (meth)acrylic acid ester compound has preferably a cycloalkyl group having 5 to 8 carbon atoms, in terms of the mechanical strength, the environmental stability of electric charge amount (a small difference in the electric charge amount depending on the environment), the polymerization easiness, and the obtainment easiness. It is preferable, accordingly, that the alicyclic (meth)acrylic acid ester compound is at least one member selected from the group consisting of cyclopentyl (meth)acrylate, cyclohexyl (meth) acrylate, cycloheptyl (meth)acrylate, and cyclooctyl (meth) acrylate. Especially, the compound preferably contains cyclohexyl (meth)acrylate in terms of the mechanical strength and the environmental stability in the electric charge amount.

The content of the structural units derived from the alicyclic (meth)acrylic acid ester compound in the resin is preferably from 10 to 100% by mass, more preferably from 20 to 100% by mass. When the content is within the range described above, the environmental stability in the electric charge amount of the carrier and durability are further improved. The content of the structural units is substantially the same as a content of the alicyclic (meth)acrylic acid ester compound to the total amount of monomers when the resin is produced.

The resin may be obtained by copolymerizing the alicyclic (meth)acrylic acid ester compound with another monomer. The other monomer may include (meth)acrylic monomers such as linear or branched (meth)acrylic acid esters and (meth)acrylic acid aminoalkyl esters; vinyl monomers such as styrene, vinyl acetate, and vinyl chloride, and the like. Of these, it is preferable to contain the (meth)acrylic monomer, and it is more preferable to contain the linear (meth)acrylic acid ester in terms of the coexistence of the abrasion resistance and the low volume resistivity. The carrier in the one embodiment of the present invention, accordingly, further contains the structural units derived from the linear (meth)acrylic acid ester compound.

When the resin contains the structural units derived from the linear (meth)acrylic acid ester compound, the content of the structural units is preferably from 10 to 90% by mass, more preferably 20 to 80% by mass in terms of the further improvement of the environmental stability in the electric charge amount and durability. The content of the structural units is substantially the same as a content of the linear (meth)acrylic acid ester compound to the total amount of monomers when the resin is produced.

The linear (meth)acrylic acid ester compound is a (meth) acrylic acid ester compound ($CH_2{=}CHCOOR$ or $CH_2{=}C(CH_3)COOR$ wherein R is a linear alkyl group. The linear (meth)acrylic acid ester monomer may specifically include methyl (meth)acrylate, ethyl (meth)acrylate, propyl (meth) acrylate, n-butyl (meth)acrylate, hexyl (meth)acrylate, octyl (meth)acrylate, and the like. Of these, (meth)acrylic acid esters whose linear alkyl group has 1 to 4 carbon atoms in terms of the easy coexistence of the abrasion resistance and the low volume resistivity, and methyl (meth)acrylate is preferable.

The branched (meth)acrylic acid ester is a (meth)acrylic acid ester compound ($CH_2{=}CHCOOR$ or $CH_2{=}C(CH_3)COOR$) in which R is a branched alkyl group. It may include, for example, tert-butyl (meth)acrylate, 2-ethylhexyl (meth)acrylate, and the like.

Examples of the (meth)acrylic acid amino ester may include dimethylaminoethyl (meth)acrylate, diethylaminoethyl (meth)acrylate, dimethylaminopropyl (meth)acrylate, diethylaminopropyl (meth)acrylate, and the like.

<<Production Method of Resin>>

The method for producing the resin is not particularly limited, and any polymerization method conventionally known, such as a pulverization method, an emulsion dispersion method, a suspension polymerization method, a solution polymerization method, a dispersion polymerization method, an emulsion polymerization method, or an emulsion polymerization coagulation method can be employed. Of these, it is preferable to produce the resin by the emulsion polymerization method in terms of the particle size control.

When the resin is produced by the emulsion polymerization method, a polymerization initiator, a surfactant and other any additives (for example, a chain transfer agent, and the like) are not particularly limited, and agents conventionally known can be used. Polymerization conditions (a temperature, a time, an atmosphere, and the like) are not also limited, and the conditions can be appropriately controlled.

The resin has preferably a weight average molecular weight of 300000 to 1000000, more preferably 350000 to 500000. When the molecular weight is within the range described above, the strength of the resin is appropriate, and thus the carrier particle surface is refreshed by the film abrasion of the coating material. The carrier, accordingly, can maintain the high electric charge amount even if it is repeatedly used, and durability is improved.

The weight average molecular weight of the resin is measured using GPC (gel permeation chromatography) in the following conditions. A measurement sample is dissolved in tetrahydrofuran in a concentration of 1 mg/mL. The sample is dissolved using an ultrasonic disperser at room temperature for 5 minutes. Then, the resulting sample is treated with a membrane filter having a pore size of 0.2 μm, and then 10 μL of the sample solution is poured into the GPC. In the molecular weight measurement of the sample, a molecular weight dispersion of the sample is calculated using an analytical curve, measured using monodisperse polystyrene standard particles. As the polystyrene used for the analytical curve measurement, the measurement is performed 10 times.

<Measurement Condition of GPC>

Apparatus: HLC-8220 (manufactured by Toso Corporation)

Column: TSKguard column+TSKgel Super HZM-M, 3 columns (manufactured by Toso Corporation)

Column Temperature: 40° C.

Solvent: Tetrahydrofuran

Flow rate: 0.2 mL/minute

Detector: Refractive index detector (RI detector).

The obtained resin may be used for the production of carriers after it is dried in spray-drying or freeze-drying, or it may be used in the state of a dispersion for the carrier production. The state can be appropriately selected depending on the production method of the carriers.

(Phosphorus Element)

The coating material in the carrier particles according to the present invention contains phosphorus element. The phosphorus element may exist as a part of the resin in the coating material. It also may exist as a compound containing the phosphorus element apart from the resin in the coating material. For example, the phosphorus element may be contained in the coating material by using a phosphorus element-containing compound as a monomer for obtaining the resin, or may exist in the coating material by addition of the phosphorus element-containing compound.

It is preferable that the phosphorus element is contained in the coating material as phosphoric acids such as phosphoric acid, phosphorous acid or phosphinic acid, an organic phosphorous compound such as a phosphoric acid ester, a phosphorous acid ester, or a component derived therefrom. When the phosphorus atom is contained in the component described above, a bond between the phosphorus atom and the oxygen atom (P═O or P—O) is polarized due to the difference in the electronegativity, and thus the coating material is greatly positively charged. Thus, the electric charge amount of the carrier is improved and thus the high electric charge amount can be provided to the low temperature fixable toner.

Especially, in the view of providing the toner with the appropriate electric charge amount and in view of the water retention, the organic phosphorus compound is more preferable, and the phosphoric acid ester is even more preferable. As the phosphoric acid ester, any of monoesters ($P(=O)(OH)_2(OR)$), diesters ($P(=O)(OH)(OR)_2$) and triesters ($P(=O)(OR)_3$) may be used. In the formulas described above, R groups are each independently any monovalent group other than hydrogen atom, and may be the same or different. In the carrier for electrostatic charge image development according to the one embodiment of the present invention, accordingly, the coating material contains the phosphorus element as a phosphoric acid group ($—O—P(=O)(OH)_2$), an acidic phosphoric acid ester group ($—O—P(=O)(OH)(OR)$) or a group of a salt thereof, or a phosphoric acid ester group ($—O—P(=O)(OR)_2$). In the formulas described above, R groups are each independently any monovalent group other than hydrogen atom, and may be the same or different.

The confirmation in which the group described above exists in the coating material can be performed, for example, by using a known mass spectrometry such as TOF-MS or LC-MS.

The content of the phosphorus element in the coating material is calculated by the following measurement method. "A ratio of the phosphorus element content (P) to the carbon element content (C) in the coating material (P/C)" is preferably from 0.0005 to 0.02. When the ratio is 0.0005 or more, the decreased electric charge amount is suppressed at a high temperature under a high humidity and the excessive electrification is suppressed at a low temperature under a low humidity. On the other hand, when the ratio is 0.02 or less, the moisture retention is appropriately suppressed, and thus charges generated by the frictional electrification are retained, and the carrier can maintain the high electric charge amount. In addition, the ratio is more preferably from 0.001 to 0.015, particularly preferably from 0.001 to 0.01, in order to maintain the electric charge amount, the environmental stability in the electric charge amount, and durability at good levels. In the carrier for electrostatic charge image development according to the one embodiment of the present invention, the ratio of the phosphorus element content (P) to the carbon element content (C) in the coating material (P/C) is from 0.001 to 0.01. The ratio P/C can be controlled by adjusting an amount of the compound containing the phosphorus element used, or the like, as described below.

<<Measurement Method of P/C>>

The ratio of the phosphorus element content (P) to the carbon element content (C) in the coating material (P/C) is measured using an X-ray photoelectron spectroscopic analyzer.

Specifically, using an X-ray photoelectron spectroscopic analyzer "K-Alpha" (manufactured by Thermo Fisher Scientific Inc.), the phosphorus element and the carbon element are quantitatively analyzed in the following analysis conditions, a surface element concentration is calculated from each atom peak area using a relative sensitivity factor, and a ratio (P/C) of a surface element concentration of the phosphorus element (P) to a surface element concentration of the carbon element (C) is calculated.

(Production of Sample)

A resin is put into a hole (a diameter of 3 mm and a depth of 1 mm) on a measurement plate for powder, and the surface thereof is made flat, which is used as a measurement sample.

(Measurement Conditions)

X-ray: Al monochrome radiation source

Acceleration: 12 kV, 6 mA

Beam: 400 μm

Path energy: 50 eV

Step size: 0.1 eV.

<<Introduction Method of Phosphorus Element to Coating Material>>

A method for introducing the phosphorus element to the coating material is not particularly limited, and a method in which the compound containing the phosphorus element is added in the stage of producing the resin is preferable. For example, it is exemplified by a method in which the resin is produced using the compound containing the phosphorus element as a surfactant or a monomer.

[Introduction Method Using Phosphorus Element-Containing Surfactant]

As one method for introducing the phosphorus element into the coating material, it is preferable to produce the resin by an emulsion polymerization using a surfactant containing the phosphorus element. When the resin is produced in the method described above, the phosphorus elements are orientated outward the resulting resin particles, and thus, resin particles having a structure in which the inside is hydrophobic but the surface easily adsorbs moisture can be obtained. In the carrier produced using such resin particle, the moisture adsorption can be decreased at a high temperature under a high humidity and, at the same time, the moisture retention can be improved at a low temperature under a low humidity. As a result, while the decreased electric charge amount can be suppressed at a high temperature under a high humidity, the excessive electrification can be suppressed at a low temperature under a low humidity. Such a carrier can provide a given electric charge amount to a toner even if the temperature and humidity environment is changed.

According to the method described above, the ratio P/C can be controlled into a desired range by appropriately adjusting an amount of the surfactant containing the phosphorus element used and washing conditions of the produced resin. The washing method of the resin may include a method in which filtration of the resin and re-dispersion in deionized water or a mixed solvent of deionized water and an alcohol are repeatedly performed, and the like. The surfactant containing the phosphorus element may be further added after the resin is produced.

It is preferable that the surfactant containing the phosphorus element is phosphoric acid ester-based surfactant such as an alkyl phosphate or a salt thereof, or a polyoxyethylene alkyl ether phosphoric acid ester or a salt thereof. When the surfactant described above is used, the carrier having the excellent moisture retention at a low temperature under a low humidity can be obtained, because the phosphorus elements are localized on the resin particle surface.

The alkyl phosphate is a compound represented by $P(=O)(OH)_{3-n}(OR)_n$ wherein R is a C4-C30 alkyl group, and n is 1 or 2. Specific examples thereof may include lauryl phosphate, tridecyl phosphate, myristyl phosphate, stearyl phosphate, oleyl phosphate, and the like. They may be used alone or as a mixture of two or more kinds.

The polyoxyethylene alkyl ether phosphoric acid ester is a compound represented by $[RO(CH_2CH_2O)_m]_nP(=O)(OH)_{3-n}$ wherein R is a C4-C30 alkyl group, n is 1 or 2, and m is 1 to 50. Specific examples thereof may include polyoxyethylene tridecyl ether phosphate, polyoxyethylene lauryl ether phosphate, and the like. Of these, polyoxyethylene tridecyl ether phosphate is preferable in terms of the productivity of the resin. They may be used alone or as a mixture of two or more kinds.

As the phosphoric acid ester-based surfactant, either commercial products or synthetic products may be used. As the commercial product, Plysurf (registered trademark) A212C, A215C, A208F, A208N, or A208B, manufactured by DKS Co., Ltd., may be used.

The amount of the surfactant containing the phosphorus element used is preferably from 0.1 to 1.5% by mass, relative to the total amount of the monomers, more preferably from 0.2 to 1.0% by mass, even more preferably from 0.3 to 0.5% by mass.

[Introduction Method Using Phosphorus Element-Containing Monomer]

As one method for introducing the phosphorus element into the coating material, it is preferable to produce the resin by copolymerizing the alicyclic (meth)acrylic acid ester compound described above with the monomer containing the phosphorus element.

According to the method described above, the ratio P/C can be controlled into a desired range by appropriately adjusting a copolymerization ratio of the monomer containing the phosphorus element to other monomers.

Examples of the monomer containing the phosphorus element may include 2-(meth)acryloyloxyethyl acid phosphate, 2-(meth)acryloyloxypropyl acid phosphate, and the like. They may be used alone or as a mixture of two or more kinds.

[Other Introduction Method]

For introducing the phosphorus element into the coating material, for example, a polymerization initiator containing the phosphorus element may be used when the resin is produced. According to the method described above, the ratio P/C can be controlled into a desired range by appropriately adjusting an amount of the polymerization initiator used.

(Other Component Forming Coating Material) The coating material may contain, if necessary, charge control particles, conductive particles, and the like, in addition to the resin described above.

Examples of the charge control particle may include strontium titanate, calcium titanate, magnesium oxide, an azine compound, a quarternary ammonium salt, triphenyl methane, and the like. The addition amount of the charge control particles is preferably from 2 to 40 parts by mass based on 100 parts by mass of the resin in the case of strontium titanate, calcium titanate, or magnesium oxide, and from 0.3 to 10 parts by mass in the case of azine compound, quarternary ammonium salt or triphenyl methane.

Examples of the conductive particle (conducting agent) may include carbon black, zinc oxide, tin oxide, and the like. The addition amount of the conductive particles is preferably from 2 to 40 parts by mass based on 100 parts by mass of the resin in the case of carbon black, from 2 to 150 parts by mass in the case of zinc oxide, and from 2 to 200 parts by mass in the case of tin oxide.

[Core Particle]

The carrier particle forming the carrier of the present invention contain a core particle. The core particle is formed of, for example, a metal powder such as an iron powder, or various ferrites, and the like. Of these, the ferrite is preferable. Accordingly, it is preferable that the core particle according to the present invention is a ferrite particle.

As the ferrite, a ferrite containing a heavy metal such as copper, zinc, nickel or manganese, and a light metal ferrite containing an alkali metal or alkaline earth metal are preferable.

The ferrite is a compound represented by the formula: $(MO)_x(Fe_2O_3)_y$, and it is preferable to adjust a molar ratio y of $Fe_2O_3$ forming the ferrite to 30 to 95% by mole. When the molar ratio is within the range described above, desired magnetization can be easily obtained, and the carrier which hardly causes the carrier adhesion can be produced. In the formula, M is a metal atom such as manganese (Mn), magnesium (Mg), strontium (Sr), calcium (Ca), titanium (Ti), copper (Cu), zinc (Zn), nickel (Ni), aluminum (Al), silicon (Si), zirconium (Zr), bismuth (Bi), cobalt (Co), or lithium (Li). They may be used alone or as a mixture of multiple kinds. Of these, from the viewpoint that the residual magnetization is low and the preferable magnetic property can be obtained, manganese, magnesium, strontium, lithium, copper, and zinc are preferable, and manganese, magnesium, and strontium are more preferable. In the carrier for electrostatic charge image development according to one embodiment of the present invention, accordingly, the core particle is preferably a ferrite particle including at least one member selected from the group consisting of manganese, magnesium and strontium, and more preferably a ferrite particle including manganese, magnesium and strontium.

As the core particle, either commercial products or synthetic products may be used. The synthetic method may include, for example, the following method.

First, a proper amount of a starting material is weighed, and then pulverization mixing thereof is performed for preferably 0.5 hours or more, more preferably 1 to 20 hours in a wet media mill, a ball mill or a vibrating mill. The thus obtained pulverized product is pelletized using a compression molding machine, and then the resulting pellets are pre-calcined at a temperature of, preferably, 700 to 1200° C. for, preferably, 0.5 to 5 hours.

After the pulverization, water may be added to the resulting product to form into a slurry without using the compression molding machine, and then the slurry may be formed into particles using a spray dryer. After the pre-calcination, the particles are further pulverized using a ball mill or a vibrating mill, and then water and, if necessary, a dispersing agent and a binder such as polyvinyl alcohol (PVA) are added thereto. The viscosity thereof is adjusted and granulation is performed, and then calcination is performed. The calcination temperature is preferably from 1000 to 1500° C.; the calcination time is preferably 1 to 24 hours; and the oxygen concentration at the calcination is preferably from 0.5 to 5% by volume. When the pulverization is performed after the pre-calcination, water may be added thereto, and the pulverization may be performed in a wet ball mill or a wet a vibrating mill.

The pulverizer such as the ball mill or the vibrating mill is not particularly limited, and it is preferable to use fine beads having a particle size of 1 cm or less in the media used, in order to effectively and uniformly disperse the starting material. In addition, a degree of pulverization can be controlled by adjusting the particle size and the composition of the beads used, and the pulverization time.

The thus obtained calcined product is pulverized and classified. As the classification method, an existing wind power classification method, mesh-filtration method, or precipitation method is used, and thus, particle size control is preformed to obtain a desired particle size.

After that, if necessary, the surface is subjected to an oxide film treatment by heating it at a low temperature to control the resistance. In the oxide film treatment, a generally used rotary electric furnace or a batch electric furnace is used, and the heat treatment can be performed, for example, at 300 to 700° C. The oxide film, formed by this treatment, has preferably a thickness of 0.1 nm to 5 μm. When the thickness of the oxide film is adjusted to the range described above, the effects by the oxide film layer can be obtained, and preferably the resistance is not too increased and desired properties can be easily obtained. If necessary, the reduction may be performed before the oxide film treatment. In addition, after the classification, the particles having a low magnetic force may be separated by magnetic separation.

The core particles has preferably a shape factor (SF-1) of 110 to 140, more preferably 110 to 130, even more preferably 115 to 120. When the shape factor is within the range described above, the coating material can have a distribution in the thickness. At a part where the coating material is thin, the volume resistivity of the carrier is decreased due to the core particles having a low resistant property, and thus electrons easily move and the excessive electrification is suppressed at a low temperature under a low humidity. At a part where the coating material is thick, the charges can be held, and thus the decreased electric charge amount is suppressed at a high temperature under a high humidity. When the shape factor is within the range described above, accordingly, the carrier having the small environmental difference in the electric charge amount can be obtained. Such a carrier can provide a given electric charge amount to the toner even if the temperature and humidity environment is changed.

The shape factor SF-1 of the core particle can be adjusted by changing the composition ratio of the starting material, the degree of pulverization, and the calcination conditions (a temperature, an oxygen concentration, and the like).

The shape factor (SF-1) of the core particle is a numerical value calculated by the following formula 1:

[Mathematical Formula 1]

$$\text{Formula: SF-1}=\{(MXLNG)^2/(\text{AREA})\}\times(\pi/4)\times 100 \qquad \text{(Formula 1)}$$

In the formula described above, "MXLNG" is the maximum particle size of the core particle, and "AREA" is a projected area of the core particle. Here, the maximum particle size refers to the maximum distance between 2 parallel lines when a projected image of the core particle on a plane is put between the parallel lines. In addition, the projected area refers to an area of the projected image of the core particle on the plane. The maximum particle size and the projected area of the core particle are obtained by the following measurement methods.

100 or more core particles, randomly selected, are photographed at 150 times using a scanning electron microscope, the photographed images are incorporated into a scanner, and measurement is performed using an image processing analyzer LUZEX AP (manufactured by Nireco Corporation). The shape factor of the core particle is a value calculated as an average value of shape factors of core particle, calculated by the formula 1 described above.

The average particle size of the core particles is preferably from 20 to 60 μm as a median diameter (D50) in volume base, more preferably from 30 to 50 μm, even more preferably from 35 to 45 μm. When the average particle size is within the range described above, the sufficient contact area to the toner can be secured, and the high quality toner image can be stably formed. The median diameter (D50) described above can be measured using a laser diffraction particle size distribution measuring apparatus equipped with a wet dispersion apparatus, "HELOS & RODOS" (manufactured by Sympatec GmbH).

[Production Method of Carrier]

The carrier particles forming the carrier of the present invention is formed by coating the core particle surface with the coating material. The method for coating the core particle surface with the coating material may include a wet-coating method, a dry-coating method, a combined coating method of the wet-coating method and the dry-coating method, and the like.

(Wet-Coating Method)

The wet-coating method may include, for example, a fluidized bed-type spray coating method, an immersion-type coating method, a polymerization method, and the like.

The fluidized bed-type spray coating method is a method in which coating liquid in which the resin for coating is dissolved in a solvent is spray-coated on the surface of the core particles using a fluid spray coating apparatus, and then the film is dried to form a coating layer. The immersion-type coating method is a method in which the core particles are immersed in coating liquid in which the resin for coating is dissolved in a solvent to perform the coating treatment, and then drying is performed to form a coating film. The polymerization method is a method in which the core particles are immersed in coating liquid in which a reactive compound is dissolved in a solvent to perform the coating treatment, and then the polymerization reaction of the compound is performed by applying heat thereto to form a coating film.

(Dry-Coating Method)

The dry-coating method is a method in which mechanical impact is applied to a mixture containing the core particles, the resin, and, if necessary, the other components under heating or without heating to melt or soften the resin deposited on the core particle surface and to fix the resin to the surface, and thus, the core material surface is coated.

The apparatus applying the mechanical impact may include, for example, a high speed stirring mixer equipped with a horizontal impeller or a turbo mill (manufactured by Freund-Turbo Corporation), and a grinding mill having a rotor and a liner such as a pin mill or Kryptron (which are manufactured by Kawasaki Heavy Industries Ltd.). The high speed stirring mixer equipped with a horizontal impeller is preferably used.

The mechanical impact is applied under heating, the heating temperature is preferably from 60 to 130° C., more preferably from 80 to 120° C., even more preferably from 100 to 120° C. When the heating temperature is within the range described above, the aggregation of the coated carrier particles can be suppressed.

In the case of the dry-coating method, the amount of the resin disposed in depression parts of the core particle is large and the amount of the resin disposed in protrusion parts is small. The volume resistivity of the carrier, accordingly, can be appropriately decreased, and the environmental difference in the electric charge amount can be decreased. In addition to the effect of the thickness distribution of the coating material, the shape of the carrier particles get closer to a spherical shape by filling up the depression parts with the resin, and the fluidity is also improved. It is preferable, accordingly, that the carrier is produced by the dry-coating method.

When the carrier is produced by the dry-coating method, the amount of the resin used is preferably from 0.5 to 20 parts by mass, more preferably from 1 to 10 parts by mass, even more preferably from 2 to 5 parts by mass, based on 100 parts by mass of the core particles. When the amount is within the range described above, the carrier having both high durability and the low volume resistivity can be obtained.

The average film thickness of the coating material in the carrier particle is preferably from 0.05 to 4.0 μm, more preferably from 0.2 to 3.0 μm, even more preferably from 0.3 to 2.0 μm, particularly preferably 0.5 to 1.0 μm, in terms of the improvement of durability and the decreased volume resistance. The average film thickness of the coating material is calculated by the following method. Using a focused ion beam system "SMI 2050" (manufactured by Hitachi High-Tech Science corporation), the carrier particle is cut at a surface passing through the center of the carrier particle to produce a measurement sample. The cross-section of the measurement sample is observed with a transmission electron microscope "JEM-2010F" (manufactured by JEOL Ltd.) in a visual filed with a field magnification of 5000, the maximum film thickness and the minimum film thickness are measured in the visual field, and an average value of the 50 measured samples is defined as a film thickness of the coating material. When the coating material has the good adhesion with the core particles and the abrasion resistance, there is no problem, even if the resin used for the formation of the coating material is formed in a uniform layer state or formed in the particulate fixed state.

The volume resistivity of the carrier according to the present invention is preferably from $1.0\times10^{7}$ to $1.0\times10^{12}$ Ω·cm, more preferably from 1.0×108 to $1.0\times10^{11}$ Ω·cm, even more preferably from $1.0\times10^{9}$ to $1.0\times10^{10}$ Ω·cm. When the volume resistivity is within the range described above, the carrier is suitable for formation of the high concentration toner image. The volume resistivity is a resistance dynamically measured under a development condition caused by a magnetic brush. Specifically, an aluminum electrode drum is substituted by a photosensitive drum, the sizes thereof being the same as each other, and the carrier particles are supplied on a developing sleeve to form a magnetic brush. The magnetic brush is slide rubbed with the aluminum electrode drum, and a voltage (500 V) is applied between the developing sleeve and the drum. A current flowing the between them is measured, and thus, the volume resistivity of the carried can be obtained by using the following formula 2:

[Mathematical Formula 2]

$$DVR\ (\Omega\ \text{cm})=(V/I)\times(N\times L/Dsd) \qquad \text{(Formula 2)}$$

In the formula 2, abbreviations are each as follows:

DVR: Volume resistivity (Ω·cm)

V: Voltage between developing sleeve and drum (V)

I: Measurement current (A)

N: Developing nip width (cm)

L: Developing sleeve length (cm)

Dsd: Distance between developing sleeve and drum (cm)

In the instant specification, the measurement is performed in conditions of V=500 V, N=1 cm, L=6 cm, and Dsd=0.6 mm.

The volume resistivity of the carrier can be controlled to the desired range by appropriately adjusting the addition amount of the resin (corresponds to the thickness of the coating material), the shape of the carrier particle, and the addition amount of the conducting agent to the coating material.

The saturated magnetization of the carrier according to the present invention is preferably from 30 to 80 $Am^2/kg$, more preferably from 40 to 70 $Am^2/kg$, even more preferably from 50 to 60 $Am^2/kg$. The residual magnetization of the carrier of the present invention is preferably 5.0 $Am^2/kg$ or less, more preferably 3.0 $Am^2/kg$ or less, even more preferably 1.0 $Am^2/kg$ or less (the lower limit: 0 $Am^2/kg$). When the carrier having such magnetic properties is used, it is difficult to form a partial aggregation of the carrier. As a result, the two-component developer is uniformly dispersed on a surface of a developer-carrying member, there is no concentration unevenness, and it is possible to form a uniform toner image with high preciseness. The residual magnetization can be decreased by using ferrite. When the residual magnetization is small, the carrier itself has the good fluidity, and it is possible to obtain a two-component developer having a uniform bulk density.

<Two-Component Developer for Electrostatic Charge Image Development>

The present invention also provides a two-component developer for electrostatic charge image development containing a toner for the electrostatic charge image development and the carrier for electrostatic charge image development described above.

[Toner for Electrostatic Charge Image Development]

The toner for the electrostatic charge image development according to the present invention (hereinafter, which may also be referred to as simply the "toner") contains toner particles in which an external additive attaches to a toner matrix particle.

(Toner Matrix Particle)

The toner matrix particle in the present invention preferably contains a binding resin. In addition, the toner matrix particles may include, if necessary, additives such as a coloring agent, a releasing agent (wax) and a charge controlling agent.

<<Component Forming Toner Matrix Particle>>

[Binding Resin]

The binding resin in the toner matrix particle preferably contains a crystalline resin and an amorphous resin. When the binding resin contains the resins described above, the crystalline resin is compatibilized with the amorphous resin during the heat fixing, and the fixability at a low temperature of the toner is improved. In the two-component developer for electrostatic charge image development according to one embodiment of the present invention, accordingly, the toner contains the crystalline resin and the amorphous resin.

(Crystalline Resin)

The crystalline resin is a resin having a clear heat absorption peak in a differential scanning calorimetry (DSC), showing no step-wise heat absorption change. The clear heat absorption peak specifically refers to a heat absorption peak having a half-value width within 15° C. when the measurement is performed at a temperature elevation rate of 10° C./minute in the differential scanning calorimetry (DSC).

The crystalline resin is not particularly limited so long as it has the properties described above, and crystalline resins conventionally known in this technical field can be used. Specific examples thereof may include crystalline polyester resins, crystalline polyurethane resins, crystalline polyurea resins, crystalline polyamide resins, crystalline polyether resins, and the like. The crystalline resins may be used alone or as a mixture of two or more kinds.

Of these, as the crystalline resin, the crystalline polyester resin is preferable. Here, the "crystalline polyester resin" refers to a known polyester resin obtained by polycondensation reaction of a carboxylic acid whose valence is 2 or more (polyvalent carboxylic acid) or a derivative thereof with an alcohol whose valence is 2 or more (polyhydric alcohol) or a derivative thereof, which satisfies the heat absorption property described above.

The melting point of the crystalline polyester resin is preferably from 55 to 90° C., more preferably from 60 to 85° C., even more preferably from 70 to 75° C. When the melting point is within the range described above, the sufficient fixability at a low temperature can be obtained. The melting point of the crystalline polyester resin can be controlled by the resin composition. In the instant specification, as the melting point of the resin, a value measured by a method described in Examples is adopted.

The valences of the polyvalent carboxylic acid and the polyhydric alcohol forming the crystalline polyester resin are each preferably from 2 to 3, particularly preferably each 2. In the following, a case in which the valences are each 2 (i.e., a dicarboxylic acid component and a diol component) is explained.

As the dicarboxylic acid component, it is preferable to use an aliphatic dicarboxylic acid, and if necessary, an aromatic dicarboxylic acid may be used together. As the aliphatic dicarboxylic acid, it is preferable to use a linear type. When the linear type is used, the crystallinity is improved. The dicarboxylic acid components may be used alone or as a mixture of two or more kinds.

The aliphatic dicarboxylic acid may include, for example, oxalic acid, malonic acid, succinic acid, glutaric acid, adipic acid, pimelic acid, suberic acid, azelaic acid, sebacic acid, 1,9-nonane dicarboxylic acid, 1,10-decanedicarboxylic acid (dodecanedioic acid), 1,11-undecane dicarboxylic acid, 1,12-dodecane dicarboxylic acid (tetradecanedioic acid), 1,13-tridecane dicarboxylic acid, 1,14-tetradecane dicarboxylic acid, 1,16-hexadecane dicarboxylic acid, 1,18-octadecane dicarboxylic acid, and the like. Of these, aliphatic dicarboxylic acids having 6 to 14 carbon atoms excluding the carboxyl carbon, are preferable, aliphatic dicarboxylic acids having 8 to 12 carbon atoms are more preferable, and aliphatic dicarboxylic acid having 8 to 10 carbon atoms are even more preferable.

The aromatic dicarboxylic acid, which may be used together with the aliphatic dicarboxylic acid, may include, for example, phthalic acid, terephthalic acid, isophthalic acid, orthophthalic acid, t-butylisophthalic acid, 2,6-naphthalenedicarboxylic acid, 4,4'-biphenyldicarboxylic acid, and the like. Of these, it is preferable to use terephthalic acid, isophthalic acid, or t-butylisophthalic acid in terms of the obtainment easiness and the emulsification easiness.

In addition to the dicarboxylic acids described above, a polyvalent carboxylic acid whose valence is 3 or more, such as trimellitic acid, pyromellitic acid, 1,2,4-benzene tricarboxylic acid, 1,2,5-benzene tricarboxylic acid, or 1,2,4-naphthalene tricarboxylic acid, a dicarboxylic acid having a double bond such as maleic acid, fumaric acid, 3-hexenedioic acid, or 3-octenedioic acid, or an acid anhydride or an alkyl ester having 1 to 3 carbon atoms of the carboxylic acid compound described above may be used.

As the dicarboxylic acid component for forming the crystalline polyester resin, it is preferable that the content of the aliphatic dicarboxylic acid is preferably adjusted to 50% by construction mole, more preferably 70% by construction mole or more, more preferably 80% by construction mole or more, particularly preferably 100% by construction mole, relative to the total construction mole of the dicarboxylic acid. When the content of the aliphatic dicarboxylic acid in the dicarboxylic acid component is adjusted to 50% by construction mole or more, the crystallinity of the crystalline polyester resin can be sufficiently secured.

As the diol component, it is preferable to use an aliphatic diol, and a diol other than the aliphatic diol may be used together, if necessary. As the aliphatic diol, it is preferable to use a linear-type. When the linear-type is used, the crystallinity is improved. The diol components may be used alone or as a mixture of two or more kinds.

The aliphatic diol may include, for example, ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, neopentylglycol, and the like. Of these, aliphatic diols having 2 to 12 carbon atoms are preferable, aliphatic diols having 5 to 10 carbon atoms are more preferable, and aliphatic diols having 7 to 9 carbon atoms are even more preferable.

The diol which can be used together with the aliphatic diol may include diols having a double bond, diols having a sulfonate group, and the like. Specifically, the diol having a double bond may include, for example, 1,4-butenediol, 2-butene-1,4-diol, 3-butene-1,6-diol, 4-butene-1,8-diol, and the like. In addition, polyhydric alcohol having a valence of 3 or more such as glycerol, pentaerythritol, trimethylol propene, and sorbitol may be used.

In the diol component for forming the crystalline polyester resin, it is preferable that the content of the aliphatic diol is adjusted to 50% by construction mole or more, more preferably 70% by construction mole or more, even more preferably 80% by construction mole or more, particularly preferably 100% by construction mole, relative to the total construction mole of the diol. When the content of the aliphatic diol in the diol component is adjusted to 50% by construction mole or more, the crystallinity of the crystalline polyester resin can be secured, and the toner having the excellent fixability at a low temperature can be obtained.

The crystalline polyester resin has preferably a weight average molecular weight (Mw) of 3,000 to 100,000, more preferably 4,000 to 50,000, particularly preferably 5,000 to 20,000, in order to securely obtain both of the sufficient fixability at a low temperature and the excellent stability in the long term heat-resistant storage. In the instant specification, as the weight average molecular weight (Mw), a value obtained by a method described in Examples is adopted.

With respect to a ratio of the diol component used to the dicarboxylic acid component used, it is preferable that a molar ratio ([OH]/[COOH]) of hydroxyl groups in the diol component to carboxyl groups in the dicarboxylic acid component is from 2.5/1 to 0.5/1, more preferably from 2/1 to 1/1.

In addition, a hybrid crystalline polyester resin having crystalline polyester polymerization segments and other polymerization segment than the crystalline polyester polymerization segment can be used as the crystalline resin in the present invention.

The method for producing the crystalline polyester resin is not particularly limited, and it can be produced by polycondensation (esterification) of the dicarboxylic acid with the dialcohol utilizing a known esterification catalyst.

The catalyst which can be used in the production of the crystalline polyester resin may include compounds of an alkali metal such as sodium or lithium; compounds containing a Group 2 element such as magnesium or calcium; compounds of a metal such as aluminum, zinc, manganese, antimony, tin, zirconium, or germanium; phosphorous acid compounds; phosphoric acid compounds; amine compounds, and the like. Specifically, the tin compound may include dibutyltin oxide, tin octylate, tin dioctylate, and salts thereof. The titanium compound may include titanium alkoxides such as tetranormalbutyl titanate, tetraisopropyl titanate, tetramethyl titanate, tetrastearyl and titanate; titanium acylates such as polyhydroxytitanium stearate; titanium chelates such as titaniumtetraacetyl acetonate, titaniumlactate, and titanium triethanol aminate, and the like. The germanium compound may include germanium dioxide, and the like. The aluminum compound may include oxides such as poly(aluminum hydroxide), and aluminum alkoxides such as tributyl aluminate, and the like. They may be used alone or as a mixture of two or more kinds.

The polymerization temperature is not particularly limited, and it is preferably from 150 to 250° C. The polymerization time also is not particularly limited, and it is preferably from 0.5 to 15 hours. During the polymerization, the pressure of the reaction system may be reduced if necessary.

The content of the crystalline resin in the toner is preferably from 0.5 to 20% by mass and more preferably from 1 to 10% by mass.

(Amorphous Resin)

The amorphous resin refers to a resin which does not show a melting point when the differential scanning calorimetry (DSC) of the resin is performed, and has a comparatively high glass transition temperature (Tg). The glass transition temperature (Tg) of the amorphous resin is not particularly limited, and it is preferably from 25 to 60° C. in order to securely obtain the fixability such as the fixability at a low temperature, and the heat resistance such as the heat-resistant storage property and blocking resistance. In the instant specification, as the glass transition temperature (Tg) of the resin, a value measured by a method described in Examples is adopted.

As the amorphous resin, conventionally known amorphous resins in this technical field can be used without particular limitations, so long as they have the properties described above. Specific examples thereof may include vinyl resins, urethane resins, urea resins, and the like. Of these, the vinyl resins are preferable, because the thermoplasticity can be easily controlled.

The vinyl resin is not particularly limited so long as it is obtained by the polymerization of the vinyl compound. Examples thereof may include (meth)acrylic acid ester resins, styrene-(meth)acrylic acid ester resins, ethylene-vinyl acetate resins, and the like. They may be used alone or as a mixture of two or more kinds.

Of the vinyl resins described above, the styrene-(meth) acrylic acid ester resin is preferable, considering the plasticity during the heat-fixing. In the following, accordingly, the styrene-(meth)acrylic acid ester resin (hereinafter which may refers to sometimes "styrene-(meth)acrylic resin"), which is the amorphous resin, is explained.

The styrene-(meth)acrylic resin is a resin formed by addition polymerization of, at least, a styrene monomer with a (meth)acrylic acid ester monomer. The styrene monomer herein includes a monomer having a known side chain or a functional group in the styrene structure, in addition to the styrene represented by the structural formula: $CH_2{=}CH{-}C_6H_5$. The (meth)acrylic acid ester monomer herein contains an ester compound having a known side chain or a functional group in the structure of the acrylic acid ester derivative or methacrylic acid ester derivative, in addition to the acrylic acid ester compound represented by $CH_2{=}CHCOOR$ wherein R is an alkyl group and the methacrylic acid ester compound represented by $CH_2{=}C(CH_3)COOR$ wherein R is an alkyl group.

Examples of the styrene monomer and the (meth)acrylic acid ester monomer, capable of forming the styrene-(meth) acrylic resin are shown below.

Specific examples of the styrene monomer may include, for example, styrene, o-methyl styrene, m-methyl styrene, p-methyl styrene, α-methyl styrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene, p-n-dodecyl styrene, and the like. The styrene monomers may be used alone or as a mixture of two or more kinds.

Specific examples of the (meth)acrylic acid ester monomer may include methyl (meth)acrylate, ethyl (meth)acrylate, isopropyl (meth)acrylate, n-butyl (meth)acrylate, t-butyl (meth)acrylate, isobutyl (meth)acrylate, n-octyl (meth) acrylate, 2-ethylhexyl (meth)acrylate, stearyl (meth) acrylate, lauryl (meth)acrylate, phenyl (meth)acrylate, diethylaminoethyl (meth)acrylate, dimethylaminoethyl (meth)acrylate, and the like. The (meth)acrylic acid ester monomers may be used alone or as a mixture of two or more kinds.

The styrene-(meth)acrylic resin may further contain the following monomer compounds, in addition to the styrene monomer and the (meth)acrylic acid ester monomer described above.

The monomer compound may include, for example, compounds having a carboxyl group such as acrylic acid, methacrylic acid, maleic acid, itaconic acid, cinnamic acid, fumaric acid, monoalkyl maleate, and monoalkyl itaconate; and compounds having a hydroxyl group such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, and 4-hydroxybutyl (meth) acrylate. The monomer compounds may be used alone or as a mixture of two or more kinds.

The method for producing the styrene-(meth)acrylic resin is not particularly limited, and may include a known polymerization method such as a bulk polymerization, a solution polymerization, an emulsion polymerization, mini-emulsion method, or a dispersion polymerization using any polymerization initiator, which is usually used in the polymerization of the monomer described above, such as a peroxide, a persulfide, a persulfate, or an azo compound. In addition, a chain transfer agent, which is generally used with the aim to control a molecular weight, may be used. The chain transfer agent is not particularly limited, and may include, for example, alkyl mercaptans such as n-octyl mercaptan, mercaptofatty acid esters, and the like.

The content of the amorphous resin in the toner is preferably from 60 to 90% by mass and more preferably from 65 to 85% by mass.

[Coloring Agent]

The coloring agent may include known inorganic or organic coloring agents. The specific coloring agents are shown below.

The black coloring agent may include, for example, carbon black such as furnace black, channel black, acetylene black, thermal black, or lamp black, magnetic powder such as magnetite or ferrite, and the like.

Magenta or a red coloring agent may include C. I. Pigment Red 2, 3, 5, 6, 7, 15, 16, 48:1, 53:1, 57:1, 60, 63, 64, 68, 81, 83, 87, 88, 89, 90, 112, 114, 122, 123, 139, 144, 149, 150, 163, 166, 170, 177, 178, 184, 202, 206, 207, 209, 222, 238, or 269, and the like.

A orange or yellow coloring agent may include C. I. Pigment Orange 31 or 43, C. I. Pigment Yellow 12, 14, 15, 17, 74, 83, 93, 94, 138, 155, 162, 180, or 185, and the like.

A green or cyan coloring agent may include C. I. Pigment Blue 2, 3, 15, 15:2, 15:3, 15:4, 16, 17, 60, 62, or 66, C. I. Pigment Green 7, and the like.

A dye may include C. I. Solvent Red 1, 49, 52, 58, 63, 111, or 122, C. I. Solvent Yellow 2, 6, 14, 15, 16, 19, 21, 33, 44, 56, 61, 77, 79, 80, 81, 82, 93, 98, 103, 104, 112, or 162, C. I. Solvent Blue 25, 36, 60, 70, 93, or 95, and the like.

The coloring agents may be used alone or as a mixture of two or more kinds.

The content of the coloring agent in the toner matrix particles is preferably from 1 to 30% by mass, more preferably from 2 to 20% by mass, even more preferably from 5 to 15% by mass.

It is also possible to use a coloring agent whose surface is modified. It is possible to use a known surface-modifying agent, and specifically, a silane-coupling agent, a titanium-coupling agent, or an aluminum-coupling agent can be preferably used.

[Releasing Agent]

The releasing agent is not particularly limited, and may include, for example, known products including hydrocarbon waxes such as polyethylene wax, oxidized polyethylene wax, polypropylene wax, oxidized polypropylene wax, and microcrystalline wax; carnauba wax, fatty acid ester wax, sasol wax, rice wax, candelilla wax, jojoba oil wax, beeswax, and the like.

The content of the releasing agent is preferably from 1 to 30 parts by mass and more preferably from 5 to 20 parts by mass, based on 100 parts by mass of the binding resin.

[Charge Controlling Agent]

The charge controlling agent may include, for example, complexes of a salicylic acid derivative with a metal such as zinc or aluminum (salicylic acid metal complexes), calixarene compounds, organic boron compounds, fluorine-containing quarternary ammonium salt compounds, and the like.

The content of the charge controlling agent is preferably from 0.1 to 5 parts by mass based on 100 parts by mass of the binding resin.

<<Physical Property of Toner Matrix Particle>>

[Average Circularity]

In order to improve the electrification environmental stability and the fixability at a low temperature, the toner matrix particle has preferably an average circularity of 0.920 to 0.980, more preferably 0.930 to 0.975. Here, as the average circularity, a value measured by a method described in Examples is adopted.

[Particle Size]

With respect to the particle size of the toner matrix particle, a volume average particle size is preferably from 3 to 10 μm, more preferably from 4 to 7 μm. When the particle size is within the range described above, reproducibility of fine lines and improvement of the quality of photographic images can be attained and, at the same time, the consumption amount of the toner can be further decreased comparted to a case of using a toner having a larger particle size. In addition, the fluidity of the toner can be secured. Here, as the volume average particle size of the toner matrix particle, a value measured by a method described in Examples is adopted.

The volume average particle size of the toner matrix particles can be controlled by a concentration of a coagulant, an addition amount of a solvent, or a melting time in a coagulation/fusion step in the toner production described below, or a composition of the resin component.

(External Additive)

In order to control the fluidity or the electrostatic property, an external additive is stuck to the surface of the toner matrix particle. As the external additive, conventionally known metal oxide particles can be used, and examples thereof may include silica particles, titania particles, alumina particles, zirconia particles, zinc oxide particles, chromium oxide particles, cerium oxide particles, antimony oxide particles, tungsten oxide particles, tin oxide particles, tellurium oxide particles, manganese oxide particles, boron oxide particles, and the like. They may be used alone or as a mixture of two or more kinds.

In particular, with respect to the silica particles, it is more preferable to use silica particles produced by a sol-gel method. The silica particles produced by the sol-gel method has a characteristic of a narrow particle size distribution, and thus the particles are preferable in terms of the suppressed variation in the sticking strength. The silica particles produced by the sol-gel method has preferably a number average primary particle size of 70 to 150 nm. The silica particles having the number average primary particle size within the range described above has a particle size larger than that of another external additive, and thus they can play a role of a spacer, and have an effect of preventing embedding of other external additives having a smaller particle size in the toner matrix particles by stirring and mixing in a developing machine and also have an effect of preventing melting of the toner matrix particles to each other.

The metal oxide particles other than the silica particles produced by the sol-gel method have preferably a number average primary particle size of 10 to 70 nm, more preferably 10 to 40 nm. The number average primary particle size of the metal oxide particles can be measured, for example, by an image treatment of an image photographed by a transmission electron microscope.

Organic fine particles such as a homopolymer of styrene or methyl methacrylate or a copolymer thereof may be used as the external additive.

The metal oxide particles used as the external additive in the present invention are preferably subjected to a surface hydrophobization treatment with a known surface treatment agent such as a coupling agent. As the surface treatment agent, dimethyldimethoxysilane, hexamethyl disilazane (HMDS), methyltrimethoxysilane, isobutyltrimethoxysilane, and decyltrimethoxysilane are preferable.

It is also possible to use silicone oil as the surface treatment agent. Specific examples of the silicone oil may include, for example, cyclic compounds such as organosiloxane oligomers, octamethylcyclotetrasiloxane, decamethylcyclopentasiloxane, tetramethylcyclotetrasiloxane, and tetravinyltetramethylcyclotetrasiloxane; linear or branched organosiloxanes. It is also possible to use high reactive silicone oil at least whose end is modified, in which a modification group is introduced into the side chain, one end, both ends, one end of the side chain, or both ends of the side chain thereof. Examples of the modification group are not particularly limited, and may include an alkoxyl group, a carboxyl group, a carbinol group, a higher fatty acid modification, a phenol group, an epoxy group, a methacrylic group, an amino group, and the like. It is also possible to use silicone oil having several kinds of modification groups, such as an amino/alkoxy modification.

A mixing treatment or combined treatment may be performed using dimethyl silicone oil and modified silicone oil, and further another surface treatment agent. The treatment agent used together with the above agents may be exemplified by silane coupling agents, titanate coupling agents, aluminate coupling agents, various silicone oils, fatty acids, fatty acid metal salts, ester thereof, rosinic acid, and the like.

The metal oxide particle has preferably a hydrophobicity of about 40 to 80%. The hydrophobicity of the metal oxide particle is expressed by a degree of wettability to methanol, and is defined by the following formula 3:

[Mathematical Formula 3]

$$\text{Hydrophobicity (\%)}=(a/(a+50))\times 100 \quad \text{(Formula 3)}$$

The method for measuring the hydrophobicity is as follows. To 50 ml of distilled water in a 200 ml-beaker is added 0.2 g of particles weighed, which are the target for measurement. Methanol is slowly added dropwise through a burette whose tip is dipped in the liquid while it is slowly stirred until the whole particles get wet. When an amount of methanol necessary for completely wetting the particles is defined a (ml), the hydrophobicity is calculated from the formula 3 described above.

It is possible to use a lubricant as the external additive, in order to improve a cleaning property or transcription property. Examples thereof may include metal salts of a higher fatty acid such as a zinc, aluminum, copper, magnesium or calcium salt of stearic acid; a zinc, manganese, iron, copper, or a magnesium salt of oleic acid; a zinc, copper, magnesium, or calcium salt of palmitic acid; a zinc or calcium salt of linoleic acid, and a zinc or calcium salt of ricinoleic acid.

The addition amount of the external additive is preferably from 0.1 to 10 parts by mass and more preferably from 1 to 5 parts by mass, based on 100 parts by mass of the toner matrix particles.

The toner in the present invention has preferably a core-shell structure in terms of the improvement of the fixability at a low temperature and the heat-resistant storage property. The core-shell structure is not limited to a structure in which a core particle is completely coated with a shell layer, but may include, for example, a structure in which the core particle is not completely coated with the shell layer and the core particle exposes in places.

The core-shell structure can be confirmed by observation of the cross-sectional structure of the toner using a known means such as a transmission electron microscope (TEM) or a scanning probe microscope (SPM).

(Method for Producing Toner)

The method for producing the toner in the present invention is not particularly limited, and may include known methods such as a kneading/pulverizing method, a suspension polymerization, an emulsification coagulation method, a dissolution suspension method, a polyester extension method, and dispersion polymerization.

Of these, it is preferable to employ the emulsification coagulation method, in terms of the uniformity in the particle size, the control of the shape, and easy formation of the preferable core-shell structure.

The emulsification coagulation method is a method for producing the toner in which a dispersion of particles of a binding resin (hereinafter which may be referred to as "binding resin particles") dispersed with a surfactant or a dispersion stabilizer is mixed with a dispersion of particles of a coloring agent (hereinafter which may be referred to as "coloring agent particles") if necessary, the coagulation is performed until the particle size reaches a desired value, and melting of the binding resin particles is performed to control the shape. Here, the binding resin particles may include arbitrarily a releasing agent, a charge controlling agent, and the like.

As the preferable method for producing the toner in the present invention, one example in which a toner having the core-shell structure is obtained using the emulsification coagulation method is shown below.

(1) A step of preparing a coloring agent particle dispersion in which coloring agent particles are dispersed in an aqueous medium;

(2) a step of preparing a resin particle dispersion (a dispersion for core/shell resin particles) in which binding resin particles containing, if necessary, an internal additive such as a releasing agent or charge controlling agent are dispersed in an aqueous medium;

(3) a step of forming coagulated particles, which are the core particles, by mixing the coloring agent particle dispersion with the dispersion of the resin particles for core to obtain a resin particle dispersion for coagulation, and coagulating and fusing the coloring agent particles and the binding resin particles in the presence of a coagulant (coagulation/fusion step);

(4) a step of forming toner matrix particles having the core-shell structure by adding the dispersion of the resin particles for the shell containing the binding resin particle for the shell layer to the dispersion containing the core particles to coagulate and fuse the particles for the shell layer to the surface of the core particles (coagulation/fusion step);

(5) a step of filtering the toner matrix particles from the dispersion of the toner matrix particles (toner matrix particle dispersion) and removing the surfactant, and the like therefrom (washing step);

(6) a step of drying the toner matrix particles (drying step); and (7) a step of adding an external additive to the toner matrix particles (external additive-treating step).

The toner having the core-shell structure can be obtained by first coagulating and fusing the binding resin particles for the core particle and the coloring agent particles to produce core particles, and then adding the binding resin particles for the shell layer to the dispersion of the core particles to coagulate and fuse the binding resin particles for the shell layer on the surface of the core particles, thereby forming the shell layer coating the surface of the core particles. A toner containing a monolayered particles can be similarly produced, for example, without adding the dispersion of the resin particles for the shell in the step (4) described above.

Each step described above is explained below.

<<Step (1): Preparation Step of Coloring Agent Particle Dispersion>>

In the step, the "aqueous medium" refers to a medium containing 50 to 100% by mass of water and 0 to 50% by mass of a water-soluble organic solvent. The water-soluble organic solvent may include methanol, ethanol, isopropanol, acetone, tetrahydrofuran, and the like. Alcoholic organic solvents, which does not dissolve the obtained resin, are preferable. It is more preferable to use water alone as the aqueous medium.

<<Step (2): Preparation Step of Resin Particle Dispersion (Dispersion of Resin Particle for Core/Shell)>>

In this step, the method for dispersing the binding resin in the aqueous medium may include a method in which binding resin particles are formed from a monomer used for obtaining the binding resin, and an aqueous dispersion of the binding resin particles is prepared, and the like.

According to the method described above, a monomer for obtaining a styrene-(meth)acrylic resin is polymerized by adding it to an aqueous medium together with a polymerization initiator to obtain base particles. At that time, it is possible to use a water-soluble polymerization initiator as the polymerization initiator. As the water-soluble polymerization initiator, for example, a known water-soluble radical polymerization initiator, such as potassium persulfate or ammonium persulfate can be preferably used.

The aqueous medium is the same medium explained in Step (1), and in order to improve the dispersion stability, a surfactant such as sodiumdodecyl sulfate may be added thereto.

Next, a radical polymerizable monomer, for obtaining a vinyl resin, and a polymerization initiator are added. It is preferable to use a seed polymerization method of the radical polymerizable monomer to the base particles.

In order to control a molecular weight of the styrene-(meth)acrylic resin, a known chain transfer agent such as n-octyl mercaptan may be preferably used in the seed polymerization system for obtaining the styrene-(meth) acrylic resin particles.

In this method, a releasing agent may be contained in the styrene-(meth)acrylic resin particles by dispersing it together with the monomer at the time when the styrene-(meth)acrylic resin particles are formed from the monomer for obtaining the styrene-(meth)acrylic resin. At that time, a crystalline resin, which has been previously prepared, may further be dispersed together with the monomer.

<<Step (3): Forming Step of Core Particle>>

As the method for forming core particles of this step, the core particles can be produced in a known method, and an emulsification coagulation method is preferably used in which the resin particles dispersed in the aqueous medium are coagulated to form core particles.

When the core particles contain a structure obtained by the coagulation/fusion of the binding resin particle containing the styrene-(meth)acrylic resin, the core particles are usually formed in the emulsification coagulation method. Here, a step of coagulation/aggregation of the core particles and the coloring agent particles in the emulsification coagulation method is explained.

In this step, the resin particle dispersion (dispersion of the resin particles for the core), the coloring agent particle dispersion, which is added if necessary, and the dispersion of the other toner-forming components are mixed, thereby preparing the resin particle dispersion for coagulation, the coagulation/fusion are performed in the aqueous medium, thereby preparing a dispersion of coagulated particles. In the coagulation/fusion step, a known metal salt such as magnesium chloride can be preferably used as the coagulant. The coagulant may be added to the resin particle dispersion for coagulation as it is, or the coagulant is previously dissolved or dispersed in an aqueous medium, and the resulting product may be added to the resin particle dispersion for coagulation.

In the coagulation step, it is preferable to shorten a leaving time after the addition of the coagulant (a time until heating is started) as much as possible. It is preferable accordingly that after the addition of the coagulant, the heating of the resin particle dispersion for coagulation is started as rapidly as possible, and the temperature thereof reaches a glass transition temperature of the core resin or higher. This reason is not clear, but defects may possibly occur in which the coagulation state of the particles is changed with passage of time, or the particle size distribution of the particles forming the toner becomes unstable or a surface nature may vary. The leaving time is usually within 30 minutes, preferably within 10 minutes.

<<Step (4): Forming Step of Shell Layer>>

In this step, when the shell layer is uniformly formed on the surface of the core particles, it is preferable to adopt an emulsification coagulation method. When the emulsification coagulation method is adopted, an emulsification dispersion of the shell particles (dispersion of resin particles for the shell) is added to an aqueous dispersion of the core particles, and coagulation/fusion of the shell particles on the surface of the core particles are performed to form the shell layer.

Specifically, the resin particle dispersion for the shell is added to the core particle dispersion while the temperature in the coagulation/fusion step is maintained, and the heating and stirring is continuously slowly performed, and thus, the resin particles for the shell are coated on the surface of the core particles.

After that, at a stage where the particle size of the aggregated particles reaches a desired value, a terminator such as sodium chloride is added thereto to stop the particle growth, and then the liquid containing the aggregated particles is continuously heated and stirred. As described above, the shape of the aggregated particles is controlled by the heating temperature, stirring speed, or heating time until a desired circularity is obtained to obtain toner matrix particles. The heating and stirring conditions are not particularly limited. The toner matrix particle having the desired circularity and the uniform shape can be obtained according to the method described above.

After that, the aggregation liquid containing the toner matrix particles is preferably subjected to a cooling treatment to obtain a toner matrix particle dispersion.

<<Step (5): Washing Step>>

In this step, the filtration treatment method for filtering the toner matrix particles from the toner matrix particle dispersion is not particularly limited, and may include a centrifugal separation method, a filtration under reduced pressure using a Nutsche, a filtration method using a filter press, and the like.

Then, the washing treatment, in which adhesive materials such as the surfactant or salting agent are removed from the toner matrix particles, which has been subjected to the solid-liquid separation, is performed. For example, the particles are washed with water or an alcohol, preferably water.

Washing with water is performed until the electric conductivity of the filtrate reaches preferably 50 S/cm or less, more preferably 10 S/cm or less, in terms of reduction of an amount of remaining impurities remaining. The electric conductivity of the filtrate can be measured using a usual electric conductivity meter.

<<Step (6): Drying Step>>

In this step, the toner matrix particles obtained in Step (5) are dry-treated to obtain dried toner matrix particles. The dryer used in this step may include a spray dryer, a vacuum freeze dryer, a vacuum dryer, and the like. It is preferable to use a standing shelf dryer, a movable shelf dryer, a fluidized layer dryer, a rotary dryer, or a stirring dryer.

<<Step (7): External Additive Treatment Step>>

In this step, the external additive is added in a dry method in which the external additive is added in a powder state to the dried toner matrix particles obtained in Step (6) and mixed, and thus, the toner in the present invention is produced. As the mixing apparatus for the external additive, it is possible to use various known mixing apparatuses such as a Tubular mixer, Henschel mixer, Nauta mixer, and V-shaped mixer.

(Physical Properties of Toner)

<<Particle Size>>

The particles forming the toner in the present invention (toner particles) have preferably a volume average particle size of 3 to 10 μm, more preferably 4 to 7 μm. When the particle size is within the range described above, the fluidity of the toner is good, and the rising of the electric charge amount can be improved.

As the volume average particle size of the toner particles, specifically, a median diameter (D50) in volume base, measured by the following method, is adopted. The median diameter (D50) of the toner particles in volume base can be measured and calculated using an apparatus in which a computer system for data processing is connected to "Multisizer 3 (manufactured by Beckman Coulter Inc.)." As the measuring procedures, 0.02 g of toner particles were blended with 20 ml of a surfactant solution (surfactant solution in which, for example, a neutral detergent containing a surfactant component is 10 fold diluted with pure water with the aim of the dispersion of the toner particles), and the ultrasonic dispersion is performed for one minute to prepare a toner particle dispersion. The toner particle dispersion is poured into a beaker containing ISOTON II (manufactured by Beckman Coulter Inc.) in a sample stand until the measurement concentration reaches 5 to 10% through a pipette, a measuring machine count is set at 25000, and measurement is performed. The Multisizer 3 having an aperture diameter of 100 μm is used. The measurement range of 1 to 30 μm is divided into 256 sections and a frequency is calculated. A particle size of particles at 50% from the largest volume cumulative fraction is defined as a median diameter (D50) in volume base.

The volume average particle size of the toner particles can be controlled by controlling a coagulant concentration, an addition amount of the organic solvent, or a fusion time in the production method described above.

<<Average Circularity>>

The particles forming the toner in the present invention (toner particles) have preferably an average circularity of 0.920 to 0.980, more preferably 0.930 to 0.975. When the circularity is within the range described above, the obtained toner is more easily charged. The average circularity of the toner particles can be controlled by controlling the temperature and the time of the aging treatment in the production method described above.

The average circularity can be measured, for example, using a flow-type particle image analyzer "FPIA-3000" (manufactured by Sysmex Corporation). Specifically, the measurement can be performed by the following method. The toner particles are wetted in the aqueous surfactant solution, and ultrasonic dispersion is performed for one minute to perform the dispersion. After that, measurement is performed in a measurement condition HPF (high-magnification imaging) mode at a proper concentration of an HPF number detected of 3000 to 10000, using "FPIA-3000" and the circularity of each particle is calculated from the following formula 4. The calculated circularities of the particles are summed up, and the resulting value is divided by the total number of the particles measure to obtain an average circularity.

[Mathematical Formula 4]

$$\text{Circularity}=(\text{circumference of a circle having the same projected area as that of the particle image})/(\text{circumference of projected image of particle}) \quad \text{Formula 4}$$

[Method for Producing Two-Component Developer]

The two-component developer according to the present invention can be produced by mixing the carrier with the toner using a mixing apparatus.

The mixing apparatus may include, for example, a Henschel mixer (manufactured by Nippon Coke & Engineering Co., Ltd.), Nauta mixer (manufactured by Hosokawa Micron Corporation), a V-shaped mixer, and the like.

When the two-component developer according to the present invention is produced, the blending amount of the carrier is preferably from 70 to 98 parts by mass, more preferably from 80 to 96 parts by mass, and even more preferably from 90 to 95 parts by mass, based on 100 parts by mass of the total amount of the carrier and the toner. When the amount is within the range described above, the two-component developer having the high electric charge amount and the suppressed environmental difference in the electric charge amount can be obtained.

<Method for Forming Image>

The two-component developer of the present invention can be used in various known electrographic image-forming methods such as a monochromatic image-forming method or a full-color image-forming method. The full-color image-forming method includes a 4-cycle type image-forming method containing 4 color-developing apparatuses of yellow, magenta, cyan, and black and one electrostatic charge image carrier (which is also referred to as "xerographic photoreceptor" or simply as "photoreceptor"), and a tandem-type image-forming method in which image-forming units of all colors, having a color developing apparatus and an electrostatic charge image carrier for each color, are mounted, and both image-forming methods can be used.

As the image-forming method, specifically, using the two-component developer of the present invention, for example, electrification is performed on the electrostatic charge image carrier in an electrification apparatus (electrification step), the electrostatic charge image, electrostatically formed by image exposure (exposing step), is developed by the electrification of the toner with the carrier in the two-component developer of the present invention in a developing apparatus to develop the image and obtain the toner image (developing step). After that, the toner image is transferred to a paper (transferring step), and then the toner image transferred on the paper is fixed on a paper by a fixing treatment such as a contact heating method (fixing step), thereby obtaining a visible image.

EXAMPLES

The effects of the present invention are explained using Examples and Comparative Examples. The technical scope of the present invention, however, is not limited to Examples described below. In Examples, operations were performed at room temperature (20 to 25° C.) unless otherwise noted. "%" and "part" mean "% by mass" and "part by mass," respectively, unless otherwise noted.

<Production of Carrier>

[Production of Resin]

(Production of Resin 1)

To 5 L of an aqueous solution containing 0.3% by mass of polyoxyethylene tridecyl ether phosphate (Plysurf (registered trademark) A212C manufactured by DKS Co., Ltd.) were added cyclohexyl methacrylate and methyl methacrylate in a mass ratio of 50:50, to which potassium persulfate was added in an amount of 0.5% by mass, relative to the total monomer amount (750 g). The emulsification polymerization was performed at 75° C. for 2 hours, and the resulting product was spray-dried to produce resin 1 (a weight average molecular weight of 500000).

(Production of Resins 2 to 5)

Resin 2 to 5 (a weight average molecular weight of 500000) were obtained in the same manner as in Production of Resin 1 except that a mass ratio of cyclohexyl methacrylate and methyl methacrylate was changed according to Table 1.

(Production of Resin 6)

Resin 6 (a weight average molecular weight of 350000) was obtained in the same manner as in Production of Resin 1 except that potassium persulfate was changed to 2,2'-azobis(2-amidinopropane)dihydrochloride.

(Production of Resin 7)

Resin 7 (a weight average molecular weight of 450000) was obtained in the same manner as in Production of Resin 1 except that methyl methacrylate was changed to dimethylaminoethyl methacrylate.

(Production of Resin 8)

To 5 L of an aqueous solution containing 0.3% by mass of sodium benzene sulfonate were added cyclohexyl methacrylate and 2-acryloyloxyethyl acid phosphate in a mass ratio of 98:2, to which potassium persulfate was added in an amount of 0.5% by mass, relative to the total monomer amount (750 g). The emulsification polymerization was performed and the resulting product was spray-dried to produce resin 8 (a weight average molecular weight of 500000).

(Production of Resin 9)

Resin 9 (a weight average molecular weight of 500000) was obtained in the same manner as in Production of Resin 1 except that after the emulsification polymerization was performed, the resulting product was washed once with 10 times the amount of deionized water, and was spray-dried.

(Production or Resin 10)

Resin 10 (a weight average molecular weight of 500000) was obtained in the same manner as in Production of Resin 1 except that after the emulsification polymerization was preformed, polyoxyethylene tridecyl ether phosphate of 0.5% by mass relative to the total monomer amount was added.

(Production of Resin 11)

Resin 11 (a weight average molecular weight of 500000) was obtained in the same manner as in Production of Resin 1 except that after the emulsification polymerization was performed, polyoxyethylene tridecyl ether phosphate of 0.7% by mass relative to the total monomer amount was added.

(Production of Resin 12)

Resin 12 (a weight average molecular weight of 500000) was obtained in the same manner as in Production of Resin 1 except that after the emulsification polymerization was performed, the resulting product was washed three times with 10 times the amount of deionized water, and was spray-dried.

(Production or Resin 13)

Resin 13 (a weight average molecular weight of 500000) was obtained in the same manner as in Production of Resin 1 except that after the emulsification polymerization was performed, polyoxyethylene tridecyl ether phosphate of 1.0% by mass relative to the total monomer amount was added.

(Production of Resin 14)

Resin 14 (a weight average molecular weight of 450000) was obtained in the same manner as in Production of Resin 1 except that cyclohexyl methacrylate was changed to cyclopentyl methacrylate.

(Production of Resin 15)

Resin 15 (a weight average molecular weight of 400000) was obtained in the same manner as in Production of Resin 1 except that cyclohexyl methacrylate was change to cyclooctyl methacrylate.

(Production or Resin 16)

Resin 16 (a weight average molecular weight of 500000) was obtained in the same manner as in Production of Resin 1 except that polyoxyethylene tridecyl ether phosphate was changed to sodium benzenesulfonate.

(Production of Resin 17)

Resin 17 (a weight average molecular weight of 350000) was obtained in the same manner as in Production of Resin 6 except that polyoxyethylene tridecyl ether phosphate was changed to sodium benzenesulfonate.

(Production of Resin 18)

Resin 18 (a weight average molecular weight of 450000) was obtained in the same manner as in Production of Resin 7 except that polyoxyethylene tridecyl ether phosphate was changed to sodium benzenesulfonate.

(Production of Resin 19)

Resin 19 (a weight average molecular weight of 500000) was obtained in the same manner as in Production of Resin 1 except that the ratio of cyclohexyl methacrylate to methyl methacrylate was changed according to Table 1.

Ratios of the phosphorus element content (P) to the carbon element content (C), (P/C), of the obtained Resins 1 to 19 were measured according to the same manner as described in the item <<Measurement Method of P/C>> described above. The results are shown in Table 1.

TABLE 1

| | Monomer 1 | Monomer 2 | Polymerization initiator | Surfactant | Monomer 1:2 (Mass ratio) | P/C ratio |
|---|---|---|---|---|---|---|
| Resin 1 | cyclohexyl methacrylate | methyl methacrylate | potassium persulfate | polyoxyethylene tridecyl ether phosphate | 50:50 | 0.003 |
| Resin 2 | cyclohexyl methacrylate | — | potassium persulfate | polyoxyethylene tridecyl ether phosphate | 100:0 | 0.003 |
| Resin 3 | cyclohexyl methacrylate | methyl methacrylate | potassium persulfate | polyoxyethylene tridecyl ether phosphate | 80:20 | 0.003 |
| Resin 4 | cyclohexyl methacrylate | methyl methacrylate | potassium persulfate | polyoxyethylene tridecyl ether phosphate | 20:80 | 0.003 |
| Resin 5 | cyclohexyl methacrylate | methyl methacrylate | potassium persulfate | polyoxyethylene tridecyl ether phosphate | 10:90 | 0.003 |
| Resin 6 | cyclohexyl methacrylate | methyl methacrylate | 2 2'-azobis(2-amidinopropane)-dihydrochloride | polyoxyethylene tridecyl ether phosphate | 50:50 | 0.003 |
| Resin 7 | cyclohexyl methacrylate | dimethylaminoethyl methacrylate | potassium persulfate | polyoxyethylene tridecyl ether phosphate | 50:50 | 0.003 |
| Resin 8 | cyclohexyl methacrylate | 2-acryloyloxyethyl acid phosphate | potassium persulfate | sodium benzenesulfonate | 98:2 | 0.004 |
| Resin 9 | cyclohexyl methacrylate | methyl methacrylate | potassium persulfate | polyoxyethylene tridecyl ether phosphate | 50:50 | 0.001 |
| Resin 10 | cyclohexyl methacrylate | methyl methacrylate | potassium persulfate | polyoxyethylene tridecyl ether phosphate | 50:50 | 0.008 |
| Resin 11 | cyclohexyl methacrylate | methyl methacrylate | potassium persulfate | polyoxyethylene tridecyl ether phosphate | 50:50 | 0.01 |
| Resin 12 | cyclohexyl methacrylate | methyl methacrylate | potassium persulfate | polyoxyethylene tridecyl ether phosphate | 50:50 | 0.0007 |
| Resin 13 | cyclohexyl methacrylate | methyl methacrylate | potassium persulfate | polyoxyethylene tridecyl ether phosphate | 50:50 | 0.012 |
| Resin 14 | cyclopentyl methacrylate | methyl methacrylate | potassium persulfate | polyoxyethylene tridecyl ether phosphate | 50:50 | 0.003 |
| Resin 15 | cyclooctyl methacrylate | methyl methacrylate | potassium persulfate | polyoxyethylene tridecyl ether phosphate | 50:50 | 0.003 |
| Resin 16 | cyclohexyl methacrylate | methyl methacrylate | potassium persulfate | sodium benzenesulfonate | 50:50 | 0 |
| Resin 17 | cyclohexyl methacrylate | methyl methacrylate | 2,2'-azobis(2-amidinopropane)-dihydrochloride | sodium benzenesulfonate | 50:50 | 0 |
| Resin 18 | cyclohexyl methacrylate | dimethylaminoethyl methacrylate | potassium persulfate | sodium benzenesulfonate | 50:50 | 0 |
| Resin 19 | — | methyl methacrylate | potassium persulfate | polyoxyethylene tridecyl ether phosphate | 0:100 | 0.003 |

[Production of Core Particle]

Starting materials of 35% by mole of MnO, 14.5% by mole of MgO, 50% by mole of $Fe_2O_3$, and 0.5% by mole of SrO were weighed, which was mixed with water, and then the mixture was pulverized in a wet media mill for 5 hours to obtain a slurry. The obtained slurry was dried using a spray dryer to obtain perfectly spherical particles. A pre-calcination was performed by heating the particles at 950° C. for 2 hours, the resulting particles were pulverized in a wet ball mill using stainless steel beads having a diameter of 0.5 cm for one hour, followed by zirconia beads having a diameter of 0.3 cm for 4 hours. To the obtained slurry were added an appropriate amount of a dispersant, and a polyvinyl alcohol resin (PVA) as a binder in an amount of 0.8% by mass relative to the solid content, in order to secure the strength of the particles to be granulated. Next, the slurry was granulated using a spray dryer and dried, which was maintained in an electric furnace at a temperature of 1275° C. and an oxygen concentration of 2.5% by volume (nitrogen gas atmosphere) for 5 hours, thereby the calcination was performed. After that, cracking and particle size control by classification were performed, and then particles having a low magnetic force were separated by magnetic separation, and thus, core particles were produced. The obtained core particles had a shape factor (SF-1) of 115, an average particle size (median diameter (D50) in volume base) of 35 μm.

[Production of Carrier]

(Production of Carrier 1)

In a high speed stirring mixer equipped with a horizontal impeller were added 100 parts by mass of the core particles and 3.5 parts by mass of the resin 1, and the mixture was mixed and stirred at 22° C. for 15 minutes at a peripheral speed of the horizontal impeller of 8 m/second, and then was mixed at 120° C. for 50 minutes, and thus, the surface of the core particles was coated with the resin (a film thickness of 0.5 μm) by an action of a mechanical impact (mechano-chemical method) to produce carrier 1. The carrier 1 had a volume resistivity of $1.0\times10^{10}$ Ω·cm, a saturated magnetization of 60 $Am^2/kg$, and a residual magnetization of 1.0 $Am^2/kg$.

(Production of Carriers 2 to 19)

Carriers 2 to 19 were obtained in the same manner as in Production of Carrier 1 except that the resin 1 was changed to each of resins 2 to 19. Each obtained carrier had a volume resistivity of $1.0\times10^{10}$ Ω·cm, a saturated magnetization of 60 $Am^2/kg$, and a residual magnetization of 1.0 $Am^2/kg$.

<Production of Toner>

[Preparation of Coloring Agent Particle (A1) Dispersion]

To a solution, in which 11.5 parts by mass of sodium n-dodecyl sulfate was dissolved in 160 parts by mass of deionized water by stirring, was gradually added 24.5 parts by mass of copper phthalocyanine (C. I. Pigment Blue 15:3) while the solution was stirred. Then, a dispersion treatment was performed using stirring apparatus "Clearmix (registered trademark) W Motion CLM-0.8" (manufactured by M Technique Co., Ltd.) to prepare a coloring agent particle (A1) dispersion whose median diameter in volume base of the copper phthalocyanine particles in the solution was 126 nm.

The median diameter in volume base of the coloring agent particle in the coloring agent particle (A1) dispersion was obtained using electrophoretic light scattering photometer "ELS-800" (manufactured by Otsuka Electronics Co., Ltd.).

[Production of Crystalline Polyester Resin]

In a three-necked flask were put 300 g of 1,9-nonanediol, 250 g of dodecanedioic acid, and a catalyst $Ti(O\text{-}n\text{-}Bu)_4$ (0.014% by mass relative to carboxylic acid monomers) to prepare mixed liquid. After that, the air in the vessel was removed by a vacuum operation, and nitrogen gas was introduced into the three-necked flask to form an inert atmosphere in the flask. The mixed liquid was refluxed at 180° C. for 6 hours while it was mechanically stirred. After that, unreacted monomer components were removed by reduced-pressure distillation, and the temperature was gradually elevated to 220° C., and stirring was performed for 12 hours. When the reaction mixture showed a viscous state, it was cooled to obtain a crystalline polyester resin (B1). The obtained crystalline polyester resin (B1) had a weight average molecular weight (Mw) of 19, 500. In addition, the crystalline polyester resin (B1) had a melting point of 75° C.

Mw of the crystalline polyester resin (B1) was obtained by calculation in a manner in which, using an apparatus "HLC-8220" (manufactured by Toso Corporation) and a column "TSKguard column+TSKgel Super HZM-M, 3 columns" (manufactured by Toso Corporation), tetrahydrofuran (THF) as a carrier solvent was allowed to flow at a flow rate of 0.2 mL/minute while the column temperature was maintained at 40° C., 10 μL of the sample solution was injected into the apparatus, detection was performed using a refractive index detector (RI detector), and a molecular weight distribution of the measurement sample was calculated using an analytical curve obtained with monodisperse polystyrene standard particles.

The sample solution was prepared by dissolving the measurement sample in THF in a concentration of 1 mg/mL at room temperature for 5 minutes using an ultrasonic disperser, then the resulting solution was filtered through a membrane filter having a pore size of 0.2 μm. The analytical curve was made by using at least about 10 standard polystyrene samples. As the standard polystyrene sample, samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, manufactured by Pressure Chemical Company, were used.

The melting point of the crystalline polyester resin (B1) was obtained as a temperature of a crystalline polyester-derived heat absorption top peak top in a first temperature elevation process in the DSC curve obtained in the measurement, the DSC curve being obtained in a measurement in which, using a differential scanning calorimetry apparatus "Diamond DSC" (manufactured by PerkinElmer Inc.), 3.0 mg of a sample was enclosed in an aluminum pan and was set in a holder, an empty aluminum pan was set as a reference, and measurement was performed in a first temperature elevation process in which the temperature was elevated from 0° C. to 200° C. at an elevating rate of 10° C./minute, a cooling process in which the temperature was fallen from 200° C. to 0° C. at a cooling rate of 10° C./minute, and a second temperature elevation process in which the temperature was elevated from 0° C. to 200° C. at an elevating rate of 10° C./minute at the measurement conditions (temperature elevating and cooling conditions) in the order described above.

[Preparation of Dispersion of Resin Particles (C1) (First Stage Polymerization)]

In a 5 L reaction vessel equipped with a stirring device, a temperature sensor, a condenser tube, and a nitrogen-introducing device were put 4 g of polyoxyethylene (2) dodecyl ether sodium sulfate and 3000 g of deionized water, and the temperature of the obtained mixed liquid was elevated to 80° C. while the mixed liquid was stirred at a stirring speed of 230 rpm under nitrogen stream. After the temperature elevation, a solution in which 10 g of potassium persulfate was dissolved in 200 g of deionized water was added to the mixed liquid, and the temperature of the mixed liquid was adjusted to 75° C. A monomer mixed liquid having a composition described below was added dropwise over one hour, and then the mixed liquid was heated and stirred at 75° C. for 2 hours, and thus, the monomers were polymerized to prepare a dispersion of resin particles (C1).

| | |
|---|---|
| Styrene | 568 g |
| n-Butyl acrylate | 164 g |
| Methacrylic acid | 68 g |

[Preparation of Dispersion of Resin Particles (C2) (Second Stage Polymerization)]

In a 5 L reaction vessel equipped with a stirring device, a temperature sensor, a condenser tube, and a nitrogen-introducing device was put a solution in which 2 g of polyoxyethylene (2) dodecyl ether sodium sulfate was dissolved in 3000 g of deionized water, and the obtained mixed liquid was heated to 80° C.

Separately, a solution was prepared by dissolving a monomer mixture a composition described below at 80° C. After that, the obtained solution was added to the mixed liquid, and the resulting mixture was mixed and dispersed for one hour in a mechanical disperser having a circulating route "CLEARMIX (registered trademark)" (manufactured by M Technique Co., Ltd.) to prepare a dispersion containing emulsified particles (oil droplets). Then, an initiator solution in which 5 g of potassium persulfate was dissolved in 100 g of deionized water was prepared and added to the dispersion, and the monomers were polymerized by heating and stirring the obtained dispersion at 80° C. over one hour to prepare a dispersion of resin particles (C2).

| | |
|---|---|
| Resin particle (C1) | 42 g (in the term of solid) |
| Microcrystalline wax | 70 g |
| Crystalline polyester resin (B1) | 70 g |
| Styrene | 195 g |
| n-Butyl acrylate | 91 g |
| Methacrylic acid | 20 g |
| n-Octyl mercaptan | 3 g |

As the microcrystalline wax described above, "HNP-0190" (manufactured by Nippon Seiro Co., Ltd.) was used.

[Preparation of Dispersion of Resin Particles (C3) for Core (Third Stage Polymerization)]

To the dispersion of the resin particles (C2) was added a solution in which 10 g of potassium persulfate was dissolved in 200 g of deionized water, and to the obtained dispersion was added dropwise a mixed monomer liquid having a composition described below over one hour while the temperature of the dispersion was maintained at 80° C. After the completion of the addition dropwise, the monomers described above were polymerized by heating and stirring the obtained dispersion over two hours, and then the dispersion was cooled to 28° C. to prepare a dispersion of resin particles (C3) for a core.

| | |
|---|---|
| Styrene | 298 g |
| n-Butyl acrylate | 137 g |
| n-Stearyl acrylate | 50 g |
| Methacrylic acid | 64 g |
| n-Octyl mercaptan | 6 g |

[Preparation of Dispersion of Resin Particle (D1) for Shell]

In a reaction vessel equipped with a stirring device, a temperature sensor, a condenser tube, and a nitrogen-introducing device was put a surfactant solution in which 2.0 g of polyoxyethylene dodecyl ether sodium sulfate was dissolved in 3000 g of deionized water, and the temperature of the obtained solution was elevated to 80° C. while the solution was stirred at a stirring speed of 230 rpm under nitrogen stream. To the solution was added an initiator solution in which 10 g of potassium persulfate was dissolved in 200 g of deionized water, to which a monomer mixed liquid having a composition described below was added dropwise over 3 hours. After the addition dropwise, the monomers were polymerized by heating and stirring the obtained mixed liquid at 80° C. over one hour to prepare a dispersion of resin particles (D1) for a shell.

| | |
|---|---|
| Styrene | 564 g |
| n-Butyl acrylate | 140 g |
| Methacrylic acid | 96 g |
| n-Octyl mercaptan | 12 g |

[Production of Core/Shell Particle (Coagulation/Fusion Step)]

In a 5 L reaction vessel equipped with a stirring device, a temperature sensor, a condenser tube, and a nitrogen-introducing device were put 360 g (in the term of solid) of the dispersion of the resin particles (C3) for the core, 1100 g of deionized water, and 50 g (in the term of solid) of the dispersion of the coloring agent particles (A1), and the temperature of the obtained dispersion was adjusted to 30° C., to which a 5 N aqueous sodium hydroxide solution was added to adjust the pH of the dispersion to 10. Then, an aqueous solution in which 60 g of magnesium chloride was dissolved in 60 g of deionized water was added dropwise to the dispersion at 30° C. over 10 minutes while it was stirred. After the addition, the dispersion was maintained at 30° C. for 3 minutes, and then the temperature thereof was started to elevate. The temperature of the dispersion was elevated to 85° C. over 60 minutes, and the particle growth reaction was continued while the temperature of the dispersion was maintained at 85° C. to prepare a dispersion of pre-core particles (1).

While this state was maintained, a particle size of the pre-core particles (1) aggregated was measured using "Coulter Multisizer 3" (manufactured by Beckman Coulter Inc.), and an aqueous solution in which 40 g of sodium chloride was dissolved in 160 g of deionized water was added to the dispersion at the time when a median diameter in number base of the pre-core particles (1) reached 5.9 μm, to stop the growth of the pre-core particles (1). The resulting dispersion was stirred at a liquid temperature of 80° C. over one hour as an aging step, and thus, the melting between the pre-core particles (1) was advanced to form core particles (1).

Then, 80 g (in the term of solid) of the dispersion of resin particles (D1) for the shell was added thereto, and stirring was continued at 80° C. over one hour, and thus, the resin particles (D1) for the shell were fused to the surface of the core particles (1) to form a shell layer thereon, thus resulting in acquisition of resin particles (1). Here, to the obtained dispersion was added an aqueous solution in which 150 g of sodium chloride was dissolved in 600 g of deionized water, and an aging treatment was performed at a liquid temperature of 80° C., and the dispersion was cooled to 30° C. at the time when the average circularity of the resin particles (1) reached 0.965. After the cooling, the core/shell particles (1) had a median diameter in number base of 6.0 μm and an average circularity of 0.965.

The average circularity of the core/shell particles (1) was obtained as an average value of circularities obtained according to the measurement conditions described above using a flow-type particle image analyzer "FPIA-3000." The median diameter in number base of the core/shell particles (1) was measured using "Coulter Multisizer 3" in the same manner as in the case of the core particles (1).

[Production of Toner Matrix Particle (Washing and Drying Step)]

The dispersion of the core/shell particles (1), produced in the coagulation/fusion step was subjected to a solid-liquid separation in a centrifugal separator to form a wet cake of the core/shell particles. The wet cake was washed with deionized water at 35° C. in the centrifugal separator until the electric conductivity of the filtrate thereof reached 5 S/cm, and after that it was transferred to "Flash Jet Dryer" (manufactured by Seishin Enterprise Co., Ltd.), and was dried until the water amount thereof reached 0.8% by mass to produce toner matrix particles 1.

[Production of Toner 1 (Treatment Step with External Additive)]

To 100 parts by mass of the toner matrix particles 1 was added powders described below in amounts described below in a Henschel mixer type "FM 20 C/I" (manufactured by Nippon Coke & Engineering Co., Ltd.). The number of rotation of the impeller was adjusted so that a peripheral speed of the impeller was 40 m/second, and the stirring was performed for 15 minutes to produce toner 1.

| | |
|---|---|
| Sol-gel silica | 1.0 part by mass |
| Hydrophobic silica | 2.5 parts by mass |
| Hydrophobic titanium oxide | 0.5 parts by mass |

The sol-gel silica had been treated with hexamethyl disilazane (HMDS), which had a hydrophobicity of 72%, and a number average primary particle size of 130 nm. The "hydrophobic silica" was not subjected to the HMDS treatment, which had a hydrophobicity of 72% and a number average primary particle size of 40 nm. The "hydrophobic titanium oxide" had been subjected to the HMDS treated, which had a hydrophobicity of 55% and a number average primary particle size of 20 nm.

The temperature of the mixed powder was adjusted to 40° C.±1° C. at the time of the addition mixing of the powders to the toner matrix particles 1. The inner temperature of the Henschel mixer was controlled in a manner in which when the temperature reached 41° C., cooling water was poured into an outer bath of the Henschel mixer at a flow rate of 5 L/minute, and when the temperature reached 39° C., the cooling water was poured at a flow rate of 1 L/minute.

The obtained toner particles had a volume average particle size of 6.0 μm, and an average circularity of 0.965. The volume average particle size and the average circularity were measured as described above.

Production of Two-Component Developer

[Production of Two-Component Developer 1] (Example 1)

With 93 parts by mass of "carrier 1" was mixed 7 parts by mass of "toner 1" to produce "two-component developer 1." The two-component developer was produced by mixing the toner with the carrier in an environment of room temperature and normal humidity (a temperature of 20° C. and a relative humidity of 50% RH) using a V-shaped blender. The developer was produced by performing the treatment at the number of revolution of the V-shaped blender of 20 rpm for a stirring time of 20 minutes, and by screening the resulting mixture through a mesh having an aperture of 125 μm.

[Production of Two-Component Developers 2 to 19] (Examples 2 to 15 and Comparative Examples 1 to 4)

"Two-component developers 2 to 19" were obtained in the same manner as in Production of Two-Component Developer 1 except that carrier 1 was changed to carriers 2 to 19.

<Evaluation Method>

As an apparatus for evaluation, a commercial available digital full-color multi-function printer "Bizhub PRESS 1070" (manufactured by Konica Minolta Inc. "Bizhub" is a registered trademark of the company) was used. Each two-component developer was loaded in the printer, and the following evaluations were performed.

[Electric Charge Amount]

The electric charge amount was obtained by sampling a two-component developer for measurement from the copying machine, and performing measurement according to an electric charge amount measuring apparatus "Blow-Off type TB-200" (manufactured by Toshiba Corporation) in the following conditions.

An electric charge amount at a room temperature and normal humidity environment (20° C. and 50% RH) (NN electric charge amount) was obtained in a manner in which the machine for the evaluation was allowed to stand in the room temperature and normal humidity environment for 48 hours, then 10 paper sheets were printed, and an electric charge amount of the two-component developer was measured to obtain an initial NN electric charge amount, and 300000 paper sheets were printed, and the an electric charge amount was measured to obtain an NN electric charge amount after endurance.

An initial electric charge amount at a low temperature and low humidity environment (10° C. and 20% RH) (initial LL electric charge amount) was obtained in a manner in which the machine for the evaluation was allowed to stand in the low temperature and low humidity environment for 48 hours, then 10 paper sheets were printed, and an electric charge amount of the two-component developer was measured.

An initial electric charge amount at a high temperature and high humidity environment (30° C. and 80% RH) (initial HH electric charge amount) was obtained in a manner in which the machine for the evaluation was allowed to stand in the high temperature and high humidity environment for 48 hours, then 10 paper sheets were printed, and an electric charge amount of the two-component developer was measured.

(Evaluation Criteria of Initial NN Electric Charge Amount)

The evaluation criteria of the initial NN electric charge amount are as follows:

⊙: A range of −43 μC/g or less and −50 μC/g or more

○: A range of −40 μC/g or less and more than −43 μC/g, or a range of less than −50 μC/g and −55 μC/g or more X: A range of more than −40 μC/g, or a range of less than −55 μC/g When the initial NN electric charge amount was within a range of −40 to −55 μC/g, it was evaluated as acceptable.

(Evaluation Criteria of Initial Environmental Difference)

An electric charge amount obtained by subtracting the initial HH electric charge amount from the initial LL electric charge amount was defined as the initial environmental difference. The evaluation criteria of the initial environmental difference are as follows:

⊙: An absolute value of 5 μC/g or less

○: Absolute value of more than 5 μC/g and 8 μC/g or less

X: Absolute value of more than 8 μC/g

When the initial environmental difference was 8 μC/g or less in the absolute value, it was evaluated as acceptable.

(Evaluation Criteria of NN Electric Charge Amount after Endurance)

The evaluation criteria of the NN electric charge amount after endurance are as follows:

⊙: A range of −40 μC/g or less and −50 μC/g or more

○: A range of −36 μC/g or less and more than −40 μC/g, or a range of less than −50 μC/g and −55 μC/g or more X: A range of more than −36 μC/g, or a range of less than −55 μC/g When the NN electric charge amount after endurance was within a range of −36 to −55 μC/g, it was evaluated as acceptable.

The evaluation results are shown in Table 2. It was confirmed that the toner contained in the two-component developer produced using the carrier according to the present invention had the good initial electric charge amount, the small difference in the electric charge amount between the high temperature and high humidity environment and the low temperature and low humidity environment, and showed the good electric charge amount even after the endurance. The results described above showed that the carrier according to the present invention had the high electric charge amount capable of improving the electric charge amount of the toner even if the low temperature fixable toner was used, had the suppressed variation in the electric charge amount caused by the environmental change, and had excellent durability.

On the other hand, as shown in Comparative Example 1, when the carrier in which the phosphorus element was not contained in the coating material was used, the initial electric charge amount is low, and thus durability is poor. As shown in Comparative Examples 2 and 3, when the carrier in which the nitrogen element was contained coating material as the high electrostatic property instead of the phosphorus element was used, the electrostatic property was improved, but the excessive electrification could not be suppressed at a low temperature under a low humidity, and thus the large environmental difference in the electric charge amount was shown. As shown in Comparative Example 4, when the carrier in which the coating material did not contain the structural units derived from the alicyclic (meth) acrylic acid ester compound was used, the large environmental difference in the electric charge amount was shown due to the decreased electrostatic property at a high temperature under a high humidity. In addition, the coating material had the low film strength and poor durability, because of no rigid cyclic backbone.

TABLE 2

| | | | | Initial electric charge amount | | Environmental difference in initial electric charge amount | | Electric charge amount after endurance | |
|---|---|---|---|---|---|---|---|---|---|
| | Two-component developer No. | Carrier No. | Resin | NN electric charge amount [μC/g] | Evaluation | Environmental difference [μC/g] | Evaluation | NN electric charge amount [μC/g] | Evaluation |
| Example 1 | Two-component developer 1 | Carrier 1 | Resin 1 | −48 | ⊙ | −3 | ⊙ | −45 | ⊙ |
| Example 2 | Two-component developer 2 | Carrier 2 | Resin 2 | −48 | ⊙ | −3 | ⊙ | −46 | ⊙ |
| Example 3 | Two-component developer 3 | Carrier 3 | Resin 3 | −47 | ⊙ | −3 | ⊙ | −45 | ⊙ |
| Example 4 | Two-component developer 4 | Carrier 4 | Resin 4 | −48 | ⊙ | −5 | ⊙ | −43 | ⊙ |
| Example 5 | Two-component developer 5 | Carrier 5 | Resin 5 | −46 | ⊙ | −7 | ○ | −41 | ○ |
| Example 6 | Two-component developer 6 | Carrier 6 | Resin 6 | −50 | ⊙ | −4 | ⊙ | −48 | ⊙ |
| Example 7 | Two-component developer 7 | Carrier 7 | Resin 7 | −50 | ⊙ | −5 | ⊙ | −47 | ⊙ |
| Example 8 | Two-component developer 8 | Carrier 8 | Resin 8 | −47 | ⊙ | −3 | ⊙ | −44 | ⊙ |
| Example 9 | Two-component developer 9 | Carrier 9 | Resin 9 | −46 | ⊙ | −5 | ⊙ | −43 | ⊙ |
| Example 10 | Two-component developer 10 | Carrier 10 | Resin 10 | −49 | ⊙ | −4 | ⊙ | −46 | ⊙ |
| Example 11 | Two-component developer 11 | Carrier 11 | Resin 11 | −50 | ⊙ | −5 | ⊙ | −50 | ⊙ |
| Example 12 | Two-component developer 12 | Carrier 12 | Resin 12 | −42 | ○ | −6 | ○ | −40 | ○ |
| Example 13 | Two-component developer 13 | Carrier 13 | Resin 13 | −47 | ⊙ | −8 | ○ | −42 | ○ |
| Example 14 | Two-component developer 14 | Carrier 14 | Resin 14 | −47 | ⊙ | −4 | ⊙ | −43 | ⊙ |
| Example 15 | Two-component developer 15 | Carrier 15 | Resin 15 | −48 | ⊙ | −4 | ⊙ | −45 | ⊙ |
| Comparative Example 1 | Two-component developer 16 | Carrier 16 | Resin 16 | −41 | ○ | −5 | ⊙ | −38 | X |
| Comparative Example 2 | Two-component developer 17 | Carrier 17 | Resin 17 | −46 | ⊙ | −12 | X | −42 | ○ |
| Comparative Example 3 | Two-component developer 18 | Carrier 18 | Resin 18 | −47 | ⊙ | −14 | X | −42 | ○ |
| Comparative Example 4 | Two-component developer 19 | Carrier 19 | Resin 19 | −42 | ○ | −13 | X | −36 | X |

What is claimed is:

1. A carrier for electrostatic charge image development comprising:

carrier particles in which a core particle surface is coated with a coating material, wherein the coating material contains a resin and a surfactant, and the coating material contains only a surfactant having a phosphorus element as the surfactant, the resin contains structural units derived from an alicyclic (meth)acrylic acid ester compound, the resin has a weight average molecular weight of 300000 to 1000000, and a ratio of a phosphorus element content (P) to a carbon element content (C) in the coating material (P/C) is from 0.001 to 0.01, and the ratio of P/C is determined by x-ray photoelectron spectroscopic analysis.

2. The carrier for electrostatic charge image development according to claim 1, wherein the alicyclic (meth)acrylic acid ester compound has a cycloalkyl group having 5 to 8 carbon atoms.

3. The carrier for electrostatic charge image development according to claim 1, wherein the alicyclic (meth)acrylic acid ester compound contains cyclohexyl (meth)acrylate.

4. The carrier for electrostatic charge image development according to claim 1, wherein the content of the structural units derived from the alicyclic (meth)acrylic acid ester compound in the resin is 20 to 100% by mass.

5. The carrier for electrostatic charge image development according to claim 1, wherein the resin further contains structural units derived from a linear (meth)acrylic acid ester compound.

6. The carrier for electrostatic charge image development according to claim 1, wherein the coating material contains the phosphorus element as a phosphoric acid group, an acidic phosphoric acid ester group or a salt group thereof, or a phosphoric acid ester group.

7. The carrier for electrostatic charge image development according to claim 1, wherein the core particle is a ferrite particle including at least one member selected from the group consisting of manganese, magnesium and strontium.

8. The carrier for electrostatic charge image development according to claim 1, wherein the resin has a weight average molecular weight of 350000 to 500000.

9. The carrier for electrostatic charge image development according to claim 1, wherein the core particle has a shape factor (SF-1) of 110 to 130.

10. A two-component developer for electrostatic charge image development comprising:

a toner for electrostatic charge image development; and the carrier for electrostatic charge image development according to claim 1.

11. The two-component developer for electrostatic charge image development according to claim 10, wherein the toner for electrostatic charge image development contains a crystalline resin and an amorphous resin.

* * * * *